US008348299B2

(12) United States Patent
Ekberg

(10) Patent No.: US 8,348,299 B2
(45) Date of Patent: Jan. 8, 2013

(54) MULTIPLE DIRECT LOCK POSITIONS FOR TOURING SKI MOUNTING PLATE

(76) Inventor: Lane Ekberg, Salt Lake City, UT (US)

( * ) Notice: Subject to any disclaimer, the term of this patent is extended or adjusted under 35 U.S.C. 154(b) by 238 days.

(21) Appl. No.: 12/716,136

(22) Filed: Mar. 2, 2010

(65) Prior Publication Data

US 2010/0219614 A1 Sep. 2, 2010

Related U.S. Application Data

(63) Continuation-in-part of application No. 11/247,893, filed on Oct. 7, 2005, now Pat. No. 7,681,904.

(51) Int. Cl.
*A63C 5/00* (2006.01)

(52) U.S. Cl. ..... 280/600; 280/614; 280/11.27

(58) Field of Classification Search ..... 280/603, 280/601, 616, 604, 607, 613, 617, 633, 631, 280/614, 618, 11.27, 11.224, 1.12, 632, 600; 36/123, 125, 116

See application file for complete search history.

(56) References Cited

U.S. PATENT DOCUMENTS

| | | | | |
|---|---|---|---|---|
| 1,101,631 | A | 6/1914 | Jacques | |
| 1,223,882 | A | 4/1917 | Jacques | |
| 2,260,057 | A | 10/1941 | Rydberg | |
| 2,410,702 | A | 11/1946 | Arsenault | |
| 3,090,978 | A | 5/1963 | Hanson | |
| 3,484,958 | A | 12/1969 | Novak et al. | |
| 3,525,166 | A | 8/1970 | Rieker et al. | |
| 3,861,698 | A | 1/1975 | Greig | |
| 4,334,369 | A | 6/1982 | Brunel | |
| 4,620,375 | A | 11/1986 | Wallace | |
| 579,695 | A | 3/1987 | Carmina-Morreale | |
| 4,674,764 | A | 6/1987 | Miesen | |
| 4,720,928 | A | 1/1988 | Faber et al. | |
| 5,318,320 | A * | 6/1994 | Ramer | 280/614 |
| 5,353,522 | A | 10/1994 | Wagner | |

(Continued)

FOREIGN PATENT DOCUMENTS

DE 3811253 A1 10/1989

(Continued)

OTHER PUBLICATIONS

1993 Iditasport, http://www.adventurecorps.com/when/iditasport/1993idit.html, downloaded Mar. 5, 2005.

(Continued)

*Primary Examiner* — Hau Phan
(74) *Attorney, Agent, or Firm* — Kunzler Law Group PC

(57) ABSTRACT

A binding device for retaining footwear securely to a snowshoe, ski, snowboard, and other apparatuses for traversing mainly over snow and ice covered terrain. The mounting plate includes multiple direct locking features on the mounting plate surface which interact with mating interfaces on a ski device. At least one strap coupled to the mounting plate is disclosed for securing a boot to the mounting plate foot bed. A positional releasable axle pivot pin that may selectively articulate the mounting plate and selectively aid in a locked heel mode directly on the mounting plate is disclosed. A first position wherein the binding may articulate in a walking motion on the axle pivot pin when connected to a ski device and a second position wherein the axle pivot pin and secondary locking feature in the mounting plate may be engaged wherein articulation and the walking motion of the mounting plate is prevented.

28 Claims, 24 Drawing Sheets

U.S. PATENT DOCUMENTS

| | | | | |
|---|---|---|---|---|
| 5,440,827 | A | 8/1995 | Klebahn et al. | |
| 5,469,643 | A | 11/1995 | Forrest | |
| 5,553,403 | A | 9/1996 | McManus | |
| 5,560,633 | A * | 10/1996 | McGowan | 280/614 |
| 5,699,630 | A | 12/1997 | Klebahn et al. | |
| 5,857,272 | A | 1/1999 | Gallay | |
| 5,901,471 | A | 5/1999 | Warner | |
| 5,944,334 | A | 8/1999 | Zhao | |
| 5,966,844 | A | 10/1999 | Hellerman et al. | |
| 6,112,436 | A | 9/2000 | Quellais | |
| 6,163,984 | A | 12/2000 | Faber et al. | |
| 6,233,849 | B1 | 5/2001 | Gallay et al. | |
| 6,243,972 | B1 | 6/2001 | De France | |
| 6,267,402 | B1 | 7/2001 | Julien | |
| 6,347,805 | B1 | 2/2002 | Maravetz et al. | |
| 6,367,173 | B2 | 4/2002 | Lancon | |
| 6,374,518 | B2 | 4/2002 | Warner | |
| 6,453,581 | B1 | 9/2002 | Kiniry et al. | |
| 6,505,423 | B1 | 1/2003 | Klebahn et al. | |
| 6,604,755 | B2 | 8/2003 | Ayliffe et al. | |
| 6,612,605 | B2 | 9/2003 | Andrus et al. | |
| 6,631,918 | B2 | 10/2003 | Silva | |
| 6,637,766 | B2 | 10/2003 | Cuzzit et al. | |
| 6,684,534 | B2 | 2/2004 | Dodge | |
| 6,898,874 | B2 | 5/2005 | Emerson et al. | |
| 6,931,762 | B1 | 8/2005 | Dua | |
| 6,971,652 | B2 * | 12/2005 | Bobbert et al. | 280/11.27 |
| 7,207,126 | B2 | 4/2007 | Gantier et al. | |
| 2001/0038192 | A1 | 11/2001 | McManus et al. | |
| 2002/0017771 | A1 | 2/2002 | McManus et al. | |
| 2003/0052473 | A1 | 3/2003 | Perkins et al. | |
| 2007/0163151 | A1 | 7/2007 | Monsees et al. | |
| 2007/0209236 | A1 | 9/2007 | Ishak | |

FOREIGN PATENT DOCUMENTS

| | | |
|---|---|---|
| EP | 1224879 | 1/2002 |
| EP | 1555050 | 1/2005 |
| FR | 2786371 | 11/1998 |
| WO | 0013538 | 12/1998 |

OTHER PUBLICATIONS

TSL Snowshoes, http://www.tslsport.com/www/?country=us&Ig-en, downloaded Dec. 13, 2007.

Lowa Step-in Snowshoe, http://www.allbusiness.com/retail-trade/miscellaneous-retail-miscellaneous/4255143-1.html, downloaded Nov. 1, 2007.

Yupi Skishoes, www.yupiskishoes.com, downloaded Jul. 14, 2006.

Play whistler.com www.playwhistler.com, downloaded Jul. 14, 2006.

* cited by examiner

FIG.4A(EXAMPLE 1)

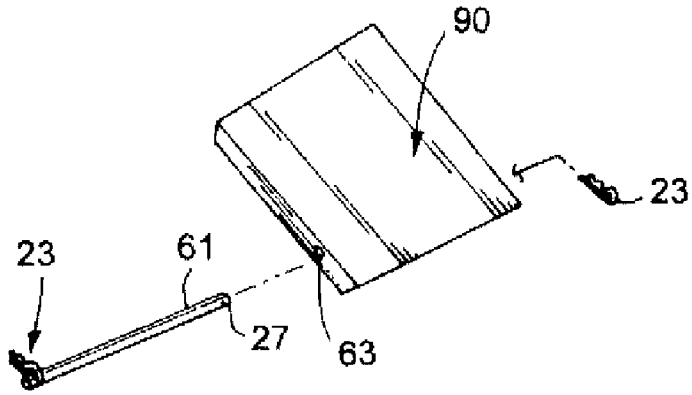
FIG.13B
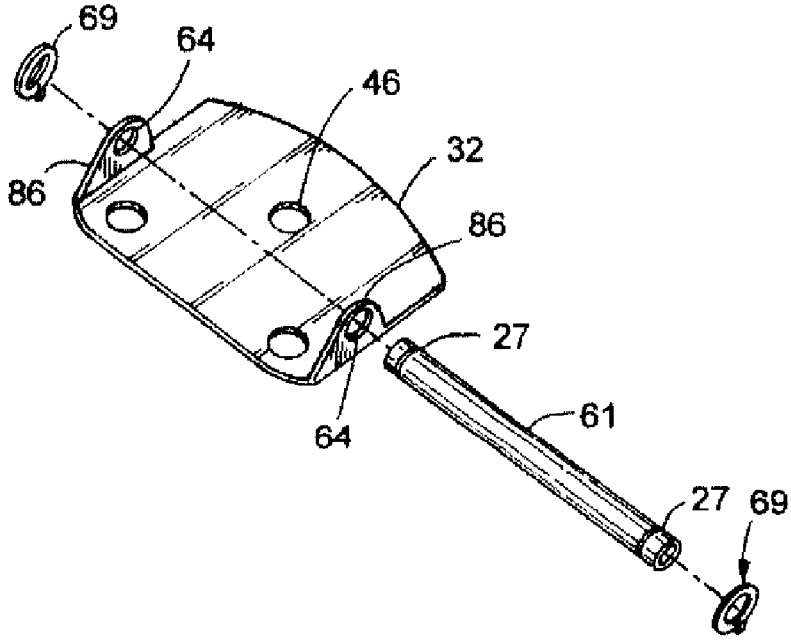

MULTIPLE DIRECT LOCK POSITIONS FOR TOURING SKI MOUNTING PLATE

CROSS-REFERENCES TO RELATED APPLICATIONS

This application is a continuation in part and claims benefit of U.S. patent application Ser. No. 11/247,893 entitled "CONFIGURABLE SNOWSHOE AND SKI DEVICE" and filed on Oct. 7, 2005 for Lane Ekberg, which is incorporated herein by reference.

BACKGROUND OF THE INVENTION

This invention relates to the field of devices that traverse over snow, ice, and colder climates of the earth in a climbing or sliding fashion. Namely, foot retention devices otherwise known in the field as bindings, binding plates, mounting plates, snowboard bindings, and touring ski bindings, soft shelled boot bindings, and especially those meant for selective free heel touring and lock heel sliding positions for ski shaped devices. This invention also relates to binding assemblies oriented mainly for soft shelled boots that serve a touring ski mode with which the user may move in a walking motion and may also secondarily connect to a sliding device such as a ski or snowboard. Touring binding systems are used for retaining footwear to a particular device for traversing over snow and ice covered terrain in a walking fashion. These binding systems need to be very versatile to be selectively placed on the skis in a touring walking or telemark or cross-country mode or in an additional mode for lock heel sliding. Split-boards and/or touring snowboards require a touring binding assembly and separate mounting plate adaptors with which to selectively allow a touring position for a cross-country style ascension mode and a secondary mode to selectively lock the mounting plate adaptor position for sliding down hill. The user mounts a separate snowboard binding assembly and binding base to the mounting plate assembly which costs a lot and weighs a lot. When the touring binding base plate adaptor is mounted to the system it has the selective ability to pivot allowing a walking motion.

It also has the ability to accept standard issue snowboard binding systems using three hole and four hole mounting disks. Additionally, the mounting plate, in one embodiment may optionally change from a walking pivot binding position by a quick-release axle located at a toe region on the base plate adaptor to a fixed non-walking "sliding" position by simply selectively reconnecting the base plate adaptor at a region between the heel and toe region of the base plate portion of the touring binding system in which the footwear touring pivot is stopped.

FIELD OF THE INVENTION

This invention relates to the field of pivotal touring binding systems especially mounting plates used on ski systems, split-board systems, cross-country ski systems, snowshoe systems, and touring snowboard systems.

DESCRIPTION OF THE RELATED ART

Touring skis, split-boards and touring snowboards in general have a specific binding plate or mounting plate adaptor which is a separate piece from the snowboard binding assembly and a secondary base plate. These snowboard binding assemblies may or may not include straps mounted to the base the base mounted to the mounting plate. The straps typically have ratchets buckles for adjusting different boot sizes within the binding assembly. Skis also have a mounting plate for boots or hard shell boots. Some manufacturers have binding configurations to accept soft shelled boots. In most instances strapless systems are used for a hands free step-in type engagement to the device for riding.

In the current state of the art touring skis, touring snowboards, and split-boards are all limited by cumbersome binding systems which have complex hardware, a multitude of parts, adaptors, and interfaces that take up space, weight, money, and time.

All current touring ski systems and touring snowboard systems have a complex binding set-up that is heavy and most importantly takes up too much space and is too expensive. There also lacks a binding system that can allow multiple and selective or touring ski pivots. In other words a mounting plate for footwear to rest on consists of a single pivot axis for walking and it is typically fixed so that the touring mode can never unlock releasing the binding from the touring position in a quick-release fashion. However, split-board or touring snowboard bindings have a "short" quick-release touring axle which releases an adaptor plate. The prior art snowboard touring systems teach a standard utility which uses a standard 3 or 4 hole disk used in most snowboard binding boot mounting systems. Furthermore selectively connected to the adaptor plate with the use of tools is the said snowboard binding assembly with straps and a separate base plate or hard shell ski binding which are to be connected to the mounting plate adaptor. The prior art of soft shelled boot touring has not produced a mounting plate that includes front and rear strap portions connected directly to the mounting plate for retaining soft shelled boots when touring including a releasable touring axle pivot pin for multiple travel modes.

There is also a need in the art of winter ski touring and snowboard touring to provide a touring binding mounting plate which has the ability to connect and disconnect at the toe region of the binding mounting plate so that the binding mounting plate can be separated from the device and can be reconnected to the device or separate device between the toe and the heel region of the binding plate "directly" eliminating the need for a separate interfaces or plates to achieve a locked heel stance or non-pivotal gliding stance. The binding mounting plate could be used on a snowshoe, ski, snowboard, or split-board and except soft shelled boots though a hard shelled boot may also be used in a separate configuration or embodiment including a strapless step-in system with the mounting plate design. There is also a need for a touring binding system and mounting plate that is very compact and light weight and very easy to use and manufacture. Additionally, a need exists for a binding that is very sturdy and strong but remains light weight and can be utilized on split-board, snowboard, touring ski, telemark ski, separate climbing cleat, or snowshoe.

Pivot pins, axles, clevis pins, used in the prior art adaptor mounting plate are relatively short thus causing more damage to the parts they are connected to because of the tremendous force exerted when sliding down a mountain side. What is needed is a longer axle pivot pin which creates a sturdier stance for the rider and less wear and tear on the parts the pin is mounted. Additionally, torsion stiffness between the rider and the sliding device is much improved with the longer pin directly mounted to the mounting plate binding and ski device. Furthermore, pivot pins in the past relied on a pin with one separate locking component permanently connected to just one side of the pin. The current invention overcomes the present state of the art by providing an axle pivot pin with separate locking features connected to both sides of the pin.

SUMMARY OF THE INVENTION

The present invention has been developed in response to the present state of the art, and in particular, in response to the problems and needs in the art that have not been fully solved by current available touring binding systems and mounting plates for soft shelled boots used on touring skis, spit-boards, and touring snowboards. Accordingly, the present invention has been developed to provide an apparatus, system, and method for overcoming the short comings of the art including a selective touring mode binding assembly and mounting plate that attaches footwear to touring skis, touring snowboard bindings, split-boards, and even snowshoes with the use of a rigid removable axle axis located in the a transverse toe region of the mounting plate making possible a walking motion. Additionally, the binding system or mounting plate may also have mountable means for traction to be applied in a separate embodiment to increase climbing traction. In one embodiment the selective axle pivot pin transverse position may be located on the front half of the binding plate or rear half of the binding plate adjacent the sole of the boot with the boot unable to slide off the mounting area with the use of two straps though just one could be used in a separate embodiment. In another embodiment the mounting plate front toe portion is in a turned upward fashion or has a slight upward bend to further prevent the boot from moving forward in the mounted position on the mounting plate Furthermore, the said selective touring mounting plate may be configured to accept one selective axle positions located on the mounting plate allowing the footwear to pivot on a device such as a ski or snowshoe or the mounting plate may be placed in a second position interface with the axle pivot pin locked in so the binding cannot pivot on items such as a snowboard or ski lock heel interfaces. The mounting plate is able to perform all of the above utility without the use of complex systems, interfaces, binding plates, parts, tools, etc. These advantages overcome many or all of the above-discussed shortcomings in the art. Most importantly, these advantages create a footwear retaining mounting plate assembly which directly locks and unlocks in quick-release fashion a down hill sliding locked heel mode and a secondary quick-lock and release at a touring position on the mounting plate creating a walking mode for touring with a single axle pin on one mounting plate.

In one embodiment the device may include a mounting plate with a foot bed for a boot to rest upon, namely a mounting plate with direct strap connection means on either side of the mounting plate for which a resilient strap can be mounted to the sides of the mounting plate. In a separate embodiment the mounting plate contains flanges extending upward from the foot bed of the mounting plate for the straps to be mounted. The said mounting plate contains a removable axle pivot pin portion at the front portion of the mounting plate touring region or toe region of the mounting plate for a walking motion, and a secondary selective locking position and locking means rearward the toe region locking area on the mounting plate. The secondary lock position rearward the touring lock position prevents the mounting plate from pivoting while coupled to the device.

This binding system mounting plate may be configured to be used on any winter device that glides over snow or climbs over snow from the group consisting of snowshoes, touring skis, telemark skis, touring snowboards, split boards, snowboards, and snowshoe ski hybrid devices.

In one embodiment the touring binding system consisting of an axle pivot pin portion selectively connected to the mounting plate able to lock and unlock from position on at least one interface mounted separately on the touring ski or formed with the touring ski or mounted on a snowboard of formed with the snowboard. Additionally, in a further embodiment, traction can be removable coupled to the axle pivot pin in the area on the ski located adjacent the boot of the user when the binding is locked to a touring snowboard, snowshoe, or ski system.

In one embodiment traction when detached from a touring ski, touring snowboard, or snowshoe device may be mounted separately to the mounting plate. Thus, it becomes a crampon when coupled only with the footwear.

The prior art concepts for a soft shelled boot touring binding system particularly for snowboard boots all utilize designs that the user must use a separate snowboard binding plate adaptor piece with holes oriented for the snowboard binding base and 3-4 hole disk to be mounted by bolt or screw to the separate mounting plate interface. The said interface includes a touring pivot in the toe region and secondary locking points in the interface to stop the walking tour pivot especially when in a snowboard mode thus created more weight and manufacturing than is necessary. Typical split-board bindings in the prior art utilize such bindings and interfaces. The present invention overcomes the prior art by providing a mounting plate with a detachable walking mode which includes a detachable touring axle pivot pin directly to the mounting plate and a secondary lock position also located on the mounting plate which is a locked heel position. In one embodiment of the present invention the heel is locked in a fixed or non-touring mode for sliding on a snowboard or ski by a locking mechanism connected to the sliding device that engage the underside of the mounting plate by a locking movement that runs parallel with the a longitudinal direction on the mounting plate or the direction the footwear points and on the same mounting plate the touring pivot axle can engaged in a transverse position in the mounting plate and touring ski. In a separate embodiment the heel lock may also run locking movements parallel with the touring locking motion.

The axle pivot pin used for the touring mode on the mounting plate as well as a locking tool reward the touring pivot on the mounting plate has quick-release and quick-attaching features allowing it to change position in a quick easy manner from the touring mode to other modes within the mounting plate. The axle pivot pin may have, in a separate embodiment, connective features on both axle ends which facilitate locking and unlocking the axle pivot pin from any locked mode or travel mode position. Exampled features disclosed herein are a cotter pin and c-clamp. The cotter pin offering a quick-release option for the axle pivot pin. It must be noted that a multitude of options exist to secure both ends of the axle by features present on both ends of the axle which prevent the axle from sliding one way or another from its locked position due to features on "both" sides of the axle pivot pin. At least one feature on one side of the axle may be released or moved to allow the axle pivot pin releasing movement from its docked position. The axle pivot pin has also been made longer then axles pivot pins and clevis pins in the prior art to create a longer span of strength for the rider of the climbing sliding device. In one embodiment the axle pivot pin ends extend beyond the periphery of the devices it selectively mounts to.

The mounting plate design in one embodiment consists of a foot bed for which the boot sits directly on, two side walls extending from the foot bed for resilient straps to be mounted above the plane of the foot bed. The axle pivot pin locking areas are located below the sole "plane" of the mounted boot with in at least two ribs, walls, or rail structures which support the axle pivot pin in a locked state. Portions of the walls, ribs, or rails extend downward from the mounting plate foot bed.

The mounting plate has pivot pin locking areas in the toe region of the mounting plate for the walking tour mode and secondary locking areas and structures rearward the toe pivot for a locked heel mode or a snowshoe pivotal mode, or even a secondary telemark binding plate touring position. The axle pivot pin generally is in a transverse position on the sliding device and mounting plate when inserted and locked.

Reference throughout this specification to features, advantages, or similar language does not imply that all of the features and advantages may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, and advantages, and characteristics of the invention may be combined in any suitable manner in one or more embodiments. One skilled in the art will recognize that the invention may be practiced without one or more of the specific features or advantages of a particular embodiment. In other instances, additional features or advantages may be recognized in certain embodiments that may not be present in all embodiments of the invention.

These features and advantages of the present invention will become more fully apparent from the following description and appended claims, or may be learned by practice of the invention as set forth hereunder.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of accompanying drawings, in which:

FIG. 4A is a side perspective view of the binding mounting plate system and in accordance with the present invention.

FIG. 13B is an illustration of a removable quick-release pivot axle pivot pin with axle pivot pin locking points on either side of the axle pivot pin together with a touring ski binding interface assembly.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of phrases "in one embodiment," "in an embodiment," and similar language throughout this specification may, but do not necessarily, all refer to the same embodiment.

Furthermore, the described features, structures, or characteristics, of the invention may be combined in any suitable manner in one or more embodiments. One skilled in the art will recognize, however, that the invention can be practiced without one or more of the specific details, or with other methods components, materials, and so forth. In other instances, well known structures, materials, or operations are not shown or describe in detail to avoid obscuring aspects of the invention.

Figure 1:
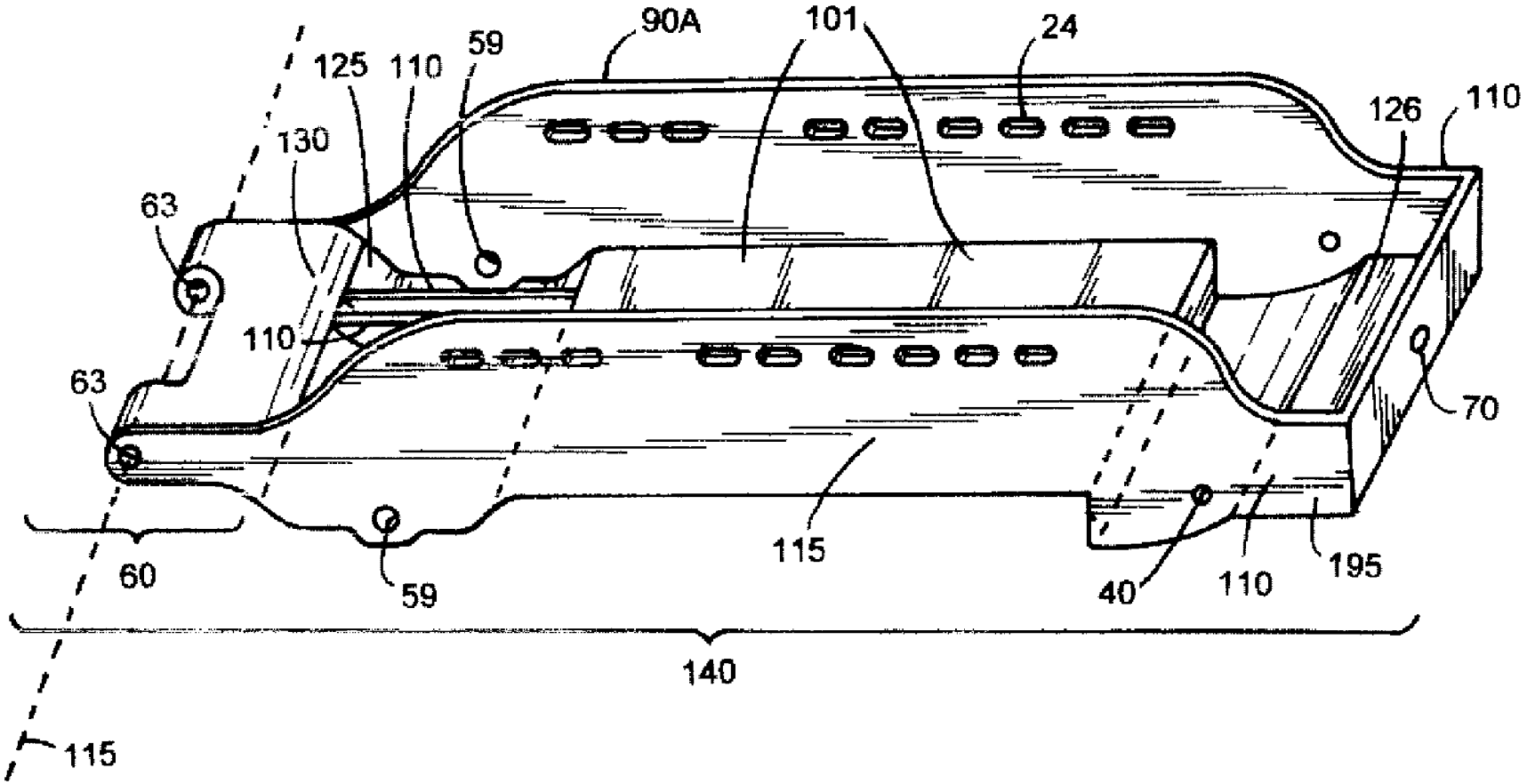
FIG. 1 is a top perspective view illustrating the binding mounting plate with direct locking zones for, free heel skiing, locked heel skiing, snowshoeing, touring snowboarding, and split-boarding in accordance with the present invention

FIG. 1 is a top perspective view of a mounting plate 90A with a touring mode section 60 at the toe region of the mounting plate 90A which accepts the detachable quick attaching axle pivot pin 61 at hole 63 and allows the mounting plate 90A to attach to the top surface of a skiing device interface (not shown) and detach from that location from the skiing device. The mounting plate 90A also has at least one secondary locking feature 59, 40, and 70 behind the touring 63 axle pivot pin 61 location. This second locking feature 59, 40, and 70, may be in the form of an axle pivot pin 61 which engages the periphery of a ski device interface (not shown) and the periphery of the mounting plate 90A in a transverse position 115 through the mounting plate 90. In another embodiment a secondary locking feature moves in a back and forth motion through heel lock feature 70 in wherein the motion is parallel or longitudinal to the side of the mounting plate 90A. Whereas the axle pivot pin 61 enters the touring mode 63 forming a transverse anchoring point for the mounting plate 90. In other words the touring mode 63 allows the axle pivot pin 61 to enter from the side of the mounting plate 90A so its two ends extend the periphery of the mounting plate 90A.

The mounting plate 90A contains a foot bed surface 101 and 130 for the boot to rest upon when coupled to the mounting plate 90A. Surface 126 and 125 are positioned below the surface 101 of the mounting plate 90A allowing the locking components movement below surface 101 and 130. Wall or rail structures 110 are also positioned below the boot bed surface 101 and or boot sole bottom plane (not shown) allowing the locking mechanism support means in one or more of the preferred embodiments 63, 59, 40, and 70 for a quick-release and quick-attaching locked heel mode with portions to be situated underneath the foot bed 101. It must be noted that the touring mode 60 may have axle pivot pin 61 in holes 63 to lock the front half mounting plate 90 portion to a riding device locking interface (not shown) and at the same time have at least one secondary locking feature in an area of the mounting plate portion 140 and the secondary locking structures on the mounting plate 90A are supported rails 110 preventing a walking motion. This locked heel mode is contained in an area 140 and is advantageous when descending on a ski device such as a ski or snowboard especially in a steep alpine setting. In one embodiment wall or rail structures 110 comprise of a pair of side walls running parallel under the foot bed top surface 101 "plane" of the mounting plate 90A. Features contained within the walls 110 constitute locking features to hold the mounting plate 90 to a separate locking interface for a free heel or locked heel mode. It would be obvious for one skilled in the art in light of the present disclosure to attempt a separate embodiment of locking structures on the underside of the mounting plate 90A under the foot bed 101 plane or boot sole plane in combination with a touring pivot mode 63 that is detachable and carry out an important aspect of the invention.

Mounting plate 90A side portion 115 includes strap attachment means with holes 24 whereby hardware such as bolts and screws or rivets (not shown) can couple at least "one" of the straps 12 and 31 to the mounting plate 90A. Secondary lock features 59, 40, and 70 are preferred embodiments though other embodiments may be used to lock a rear portion of the touring mounting plate below the foot bed creating a locked heel mode when the free heel touring mode is not desired simply by quick release and quick attaching means. In a separate embodiment locking features 59, 40, and 70 could be supported above the foot bed plane. The mounting plate 90A is preferably constructed in metals including aluminum but may be made in materials suitable for colder climates including thermo set plastics, resins, wood, poly carbonate, carbon fiber, etc.

Figure 2:
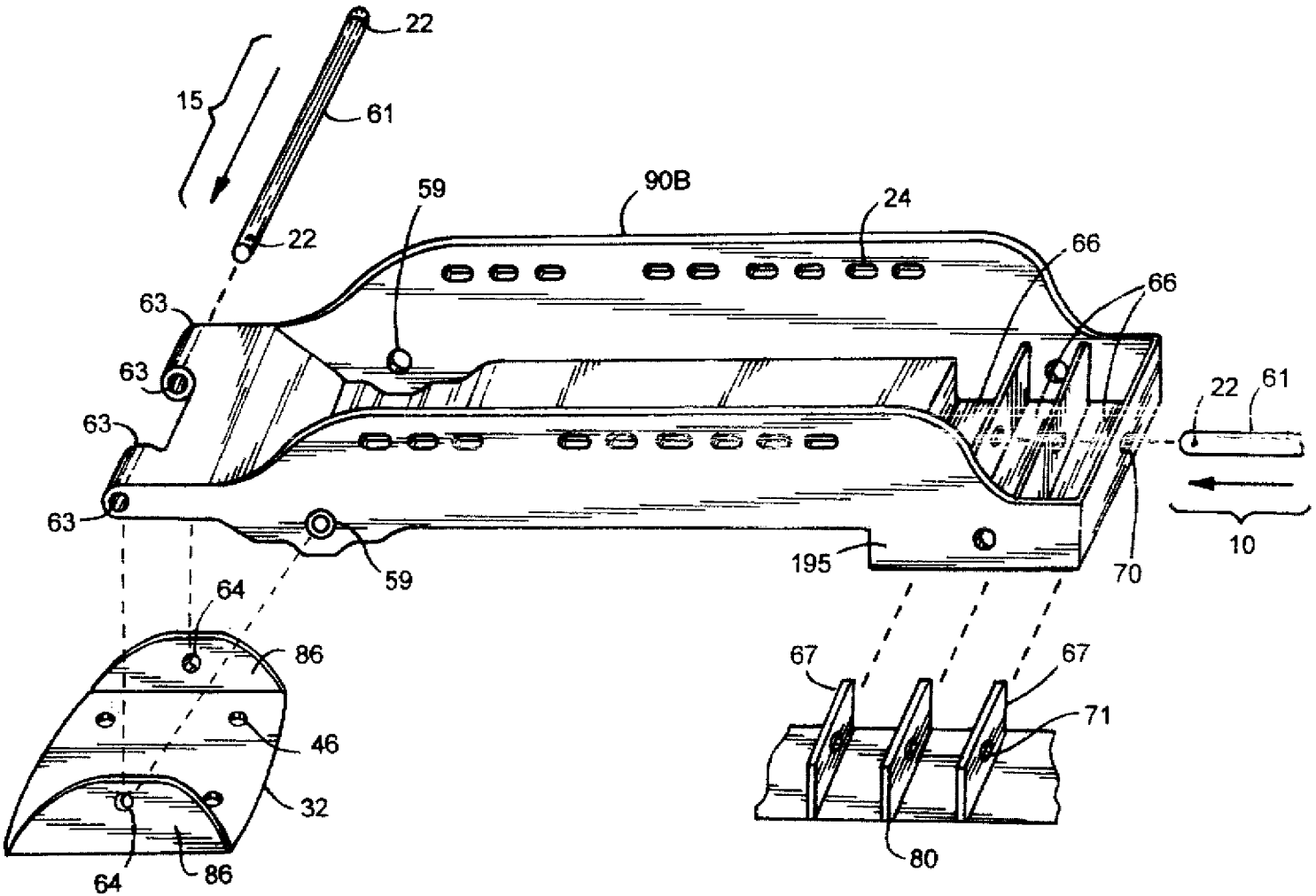
FIG. 2 is a top perspective view illustrating the binding mounting plate and an embodiment of a touring ski interface and connection means in the front half portion of the binding mounting plate. The mounting plate binding also has a second optional axis for the snowshoe position pivot, secondary telemark/cross-country pivot, or non-pivot "locked heel" position as well as a separate locking heel mechanism.

FIG. 2 is a side view illustrating the mounting plate binding 90B and a separate touring free heel ski locking interface 32 in accordance with the present invention. The axle pivot pin 61 enters flange hole 64 and touring pivot hole 63 of the touring mode 60 of the mounting plate 90B. The touring lock interface 32 may be separately coupled to the top side of a ski or snowboard with bolts or screws entering holes 46 for attachment to the said ski or snowboard sliding devices. An additional mounting plate 90B heel lock embodiment is shown in heel lock 80. In this embodiment features 67 go through square cut out open windows 66 a second axle pivot pin 61 is utilized by entering heel lock hole 70 on the mounting plate 90B and heel lock hole 71 on the ski device locking interface. The heel lock 61 is locked into place with a forward longitudinal motion 10 moving from the heel region and moving towards the front of the mounting plate 90B. The touring pivot pin 61 is shown in a motion 15 moving from one side of the mounting plate 90 to the other and one side or flange 86 of the touring interface 64 to the other side or flange 86 creating a transverse position.

The axle pivot pin hole 59 is used for a secondary lock position rearward the touring position 63 to directly lock the interface 59 to a riding device interface 64 in a quick-release quick-attach manner. This position prevents the mounting plate 90B from pivoting in a walking motion around axle pivot pin's 61 axis when the axle pivot pin 61 docked in 59. In a separate embodiment the axis 59 could be attached to a snowshoe allowing the toe region of the mounting plate 90B to dig into the snow while in the walking motion. In a further embodiment a cleat traction device could be attached to the mounting plate 90B axis point 59 or other axes or other locking features found on the mounting plate 90B.

Figure 3:
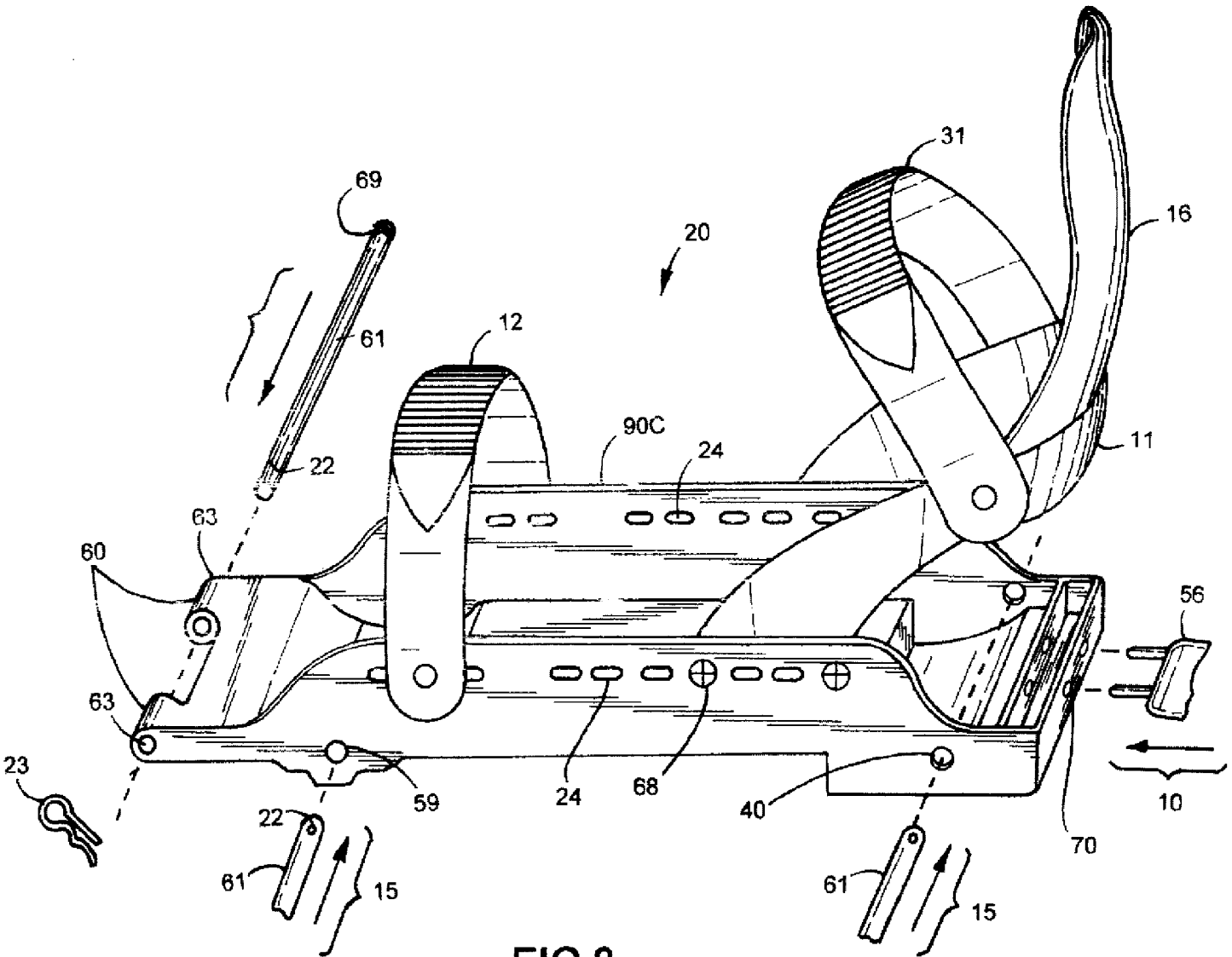
FIG. 3 is a top side perspective view illustrating the binding mounting plate accordance with the invention. is a top perspective view illustrating the binding mounting plate and direct locking zones for, free heel skiing, locked heel skiing, touring snowboarding, snowshoeing, and split-boarding in accordance with the present invention.

FIG. 3 is mounting plate binding assembly 20 which comprises multiple binding travel modes including a free heel ski touring mode 60 similar to cross-country skiing mode with the binding mounting plate 90C able to pivot about an axis made possible be axle pivot pin 61 in a walking motion. Pivot axle 61 is detachable in a quick release manner from its position in hole 63 in from the touring mode 60 when connected to a separate touring ski interface and able to selectively reattach in a quick manner to hole 59 forming a locked heel binding configuration when reattached to a locked heel interface connected to a sliding device such as a snowboard or ski. In a separate embodiment the device may be a snowshoe ski hybrid 72 (FIG. 6) and allow pivot axis 59 to rotate the mounting plate 90C through the plane of the ski (not shown). If there is no opening through the device for the mounting plate to rotate through when pivot axis 59 is used then the binding plate 90C will remain locked in a fixed lock heel mode because the mounting plate cannot rotate. When touring is again desired the axle pivot pin 61 is reentered through holes 63 and flanges on the riding device binding interface (example. FIG. 32). The axle pivot pin 61 is selectively locked in place with locking features 27 on both sides of the axle pivot pin 61 which could include a cotter pin 23 and the c-clamp 69. In other embodiments the locking features of the axle pivot pin 60 could be changed but the spirit of the utility would remain the same. Axle pivot pins in the prior art are shorter and do not include two features on both sides of the pivot pin for locking the pin in place. Pivot axle pin 61 is longer allowing the ends of the pivot axle to extend beyond the outer periphery of the mounting plate 90C with the locking features also outside the periphery of the mounting plate 90 and riding device connecting components.

The locking mechanisms on the mounting plate 90C are unique from the prior art in that they lock the mounting plate 90C in two selective places in quick release quick attach fashion to winter climbing and sliding devices. The first is the touring pivot mode 60 in which the axle pivot pin 61 enters the binding plate 90C and device interface (not shown) 90C perpendicular motion 15 to the direction footwear will point on the mounting plate 90C forming a transverse situation. In other words the pivot axle pin 61 inters the side of the binding and reappears on the other side allowing the cotter pin 23 to be inserted into cotter hole 22 in the releasable axle 61 outside the periphery of the mounting plate 90C holding the mounting plate 90C firmly in position with the ski touring flanged interface. On other portions of the mounting plate 90C secondary lock positions 59, 70, and 40 are located to facilitate a locked heel travel mode and work together with namely ski shaped devices in combination with the accessibility to the optional touring climbing mode. In a separate embodiment heel lock 56 is mounted to a ski device and enters the binding plate 90C in a longitudinal motion parallel to the direction the footwear will be pointed when mounted to the mounting plate 90C.

Thus the mounting plate 90C has the ability to directly attach to a touring interface for a walking motion. When another travel mode is desired the mounting plate 90C and axle pivot pin 61 can be repositioned directly to a separate locking interface. This second position of the mounting plate 90C prevents the binding from pivoting especially when skiing or snowboarding downhill.

The mounting plate 90C includes holes 24 on the sides of the mounting plate 90 for attaching at least one strap for securing namely soft shelled boots including snowboard boots. The mounting plate 90C in a separate embodiment may include a strap section 12 which holds the front half of the boot and a second strap section 31 that holds the rear half of boot. A heel piece 11 connected to the back half of the mounting plate 90C with highback 16 may also be included to offer more support to the rider. In a separate embodiment the mounting plate 90C may be configured as a strap-less step-in system with the same innovative features contained in the mounting plate 90 in accordance with the present invention.

FIG. 4A is a side perspective view of the mounting plate 90D illustrating a touring pivot 63 in the touring region 60 wherein the axle pivot rod 61 (not shown) can removably couple the touring mode 60 axle pivot pin 61 and releasing the mounting plate 90D from a riding device. Pivot 59 may also offer a secondary locking region for the axle pivot pin 61 to be placed preventing the mounting plate 90D from pivoting in a walking motion in one embodiment. In a separate embodiment the pivot 59 can pivot the mounting plate 90D in a snowshoe style pivot or in a limited pivot before the touring region 60 makes contact with a second surface similar to telemark style pivoting. Further locking means in the heel region 70 can also be utilized for a secondary or third locking area in the mounting plate 90D. Thus from regions heel to toe the mounting plate can be selectively locked and unlocked in a quick-release quick-attaching manner whether for touring or for lock heel travel modes. Strap 12 and 31 mount holes 24 make possible the coupling of straps 12 and 31 to the mounting plate 90D for securing footwear. Region 115 constitutes a side wall for which the straps can be mounted to the mounting plate 90D. Foot bed 101 allows a boot to rest upon its top surface. Walls 110 extend downward from the foot bed for supporting secondary locking means 70 and 59.

Figure 4B:
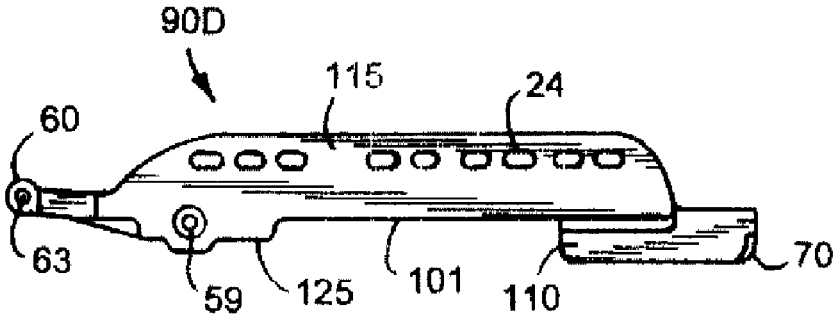
FIG.4B(PRIOR ART)
FIG. 4B is a view of a prior art mounting plate adaptor with connective features for mounting a secondary mounting plate and snowboard binding assembly and necessary hardware.
Figure 4B:
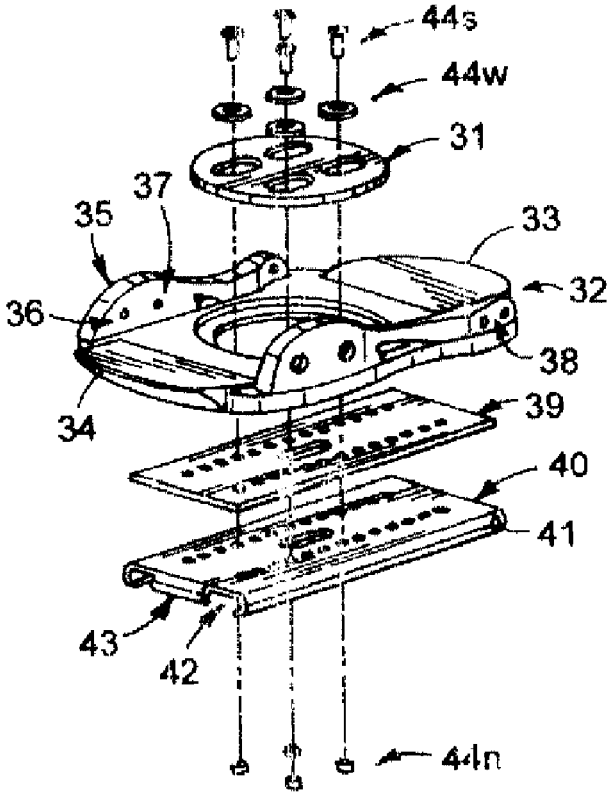
FIG.4B(PRIOR ART)

FIG. 4B is a perspective view of a prior art binding assembly. This assembly includes a separate mounting plate interface pieces 40, 39 system with a touring mode axle hole 41 for a clevis pin pivot rod. Separate mounting bolts and screws 44*s* 44*w* and 44*n* which need a separate screw drew driver or wrench to attach snow board mounting plate 32 to the top 39 and 39 attaches to 40. Disk 31 is sandwiched onto the top side of the snowboard binding base 33. It is obvious that the prior art requires many components, pieces, plates, hardware, to carry out a touring mode and a locked hill mode. Mounting plate 90A, B, C, D in FIGS. 1-3 and 4A reduce the amount of parts needed to carry out a snowboard touring binding system. Additionally, mounting plate 90D in FIG. 4A when connected to its quick-attaching interface is actually more sturdy and closer to the device than the prior art suggested in 4B. 4A offers better performance when attached to the riding device including a snowboard because of its lower connected profile. 4A is also much lighter because of few parts which is a necessary advantage when touring the back country. Mounting plate 90 overcomes all disadvantages of the prior art.

Figure 5:
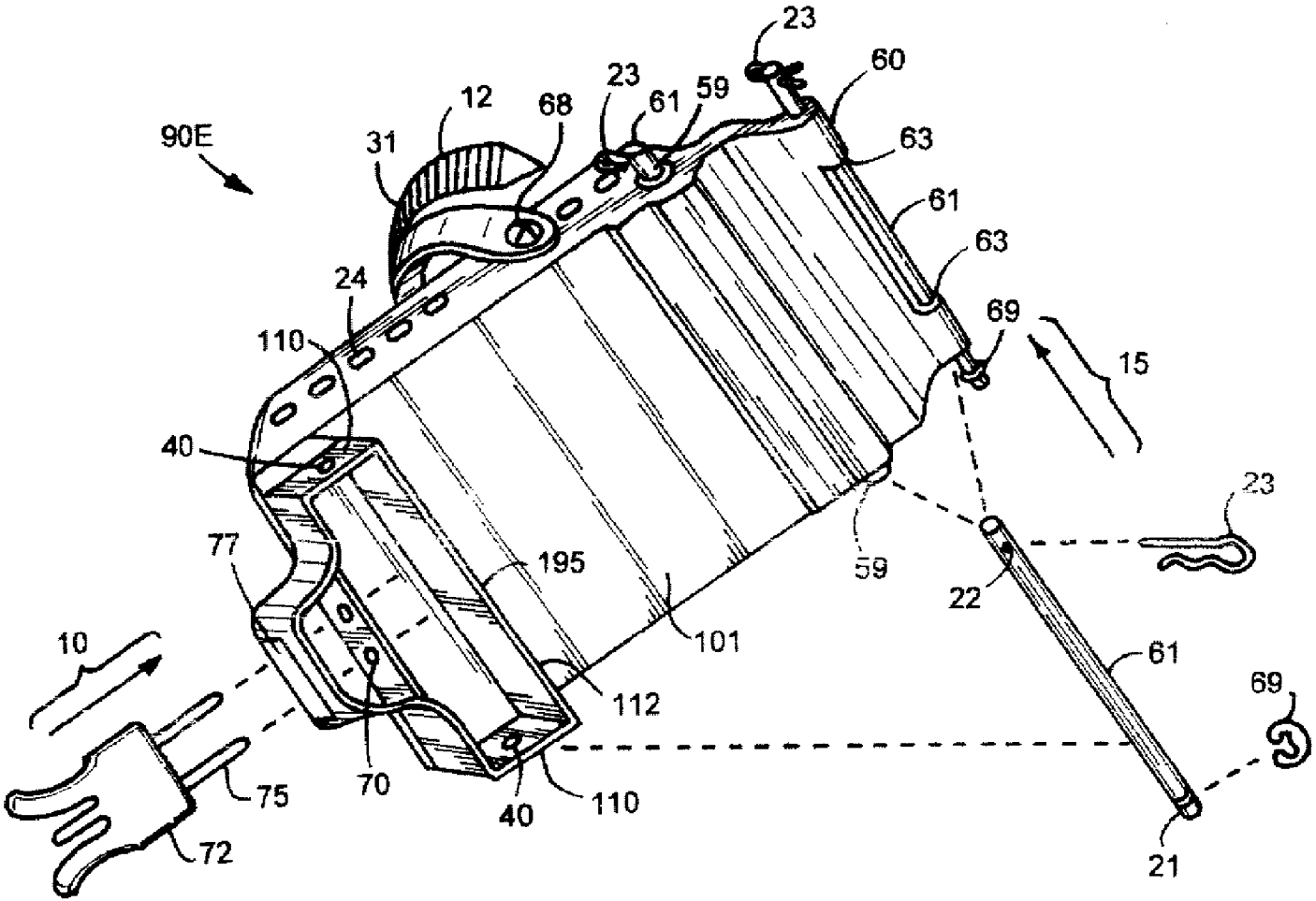
FIG. 5 is a bottom view illustrating an embodiment of the binding mounting plate and multiple quick-locking quick-release components for locked heel and free hill climbing modes supported by flanges or rails in accordance with the present invention.

FIG. 5 is a bottom perspective view of one embodiment of the mounting plate 90E in accordance with the present invention. The mounting plate 90E is shown with a box support girder type structure 195 with at least two side walls 110 and perpendicular structure 112 connected to the bottom of the mounting plate 90E at surface 101. This structure makes up a box type girder for supporting locking structures to prevent the mounting plate 90E from making a free heel touring movement. This is called a locked heel position especially for descending snow covered slopes on a skiing device. Locking structures in one or more of the disclosed embodiments may be carried out in regards to locking features 40, 70, and 77. One or more of these locking regions could be utilized. It must be noted that other locking means and interfaces could be utilized in carrying out the invention without leaving its scope.

The axle pivot pin 61 is shown is several possible docking locked locations including 63, and 59. It may also, in a separate embodiment selectively dock and lock into 40 to lock to the rear half of the mounting plate 90E. In one embodiment quick-release and quick attaching components consist of a cotter pin 23 on one end of the axle pivot pin 61 and a c-clamp 69 at the opposite end of the axle pivot pin 61. The axle pivot pin 61 moves from one side of the mounting plate 90E to the other forming a transverse span in a perpendicular motion in comparison to lock 72 motion 10 though other movement directions of the locking components could be carried out. Furthermore the structures or shapes at either end of the axle pivot pin 61 including the axle pivot pin 61 itself could prevent the axle from falling out of its locked positions. The axle pivot pin 61 is unique in comparison to the prior art wherein it transversly spans the full length of the mounting plate 90E snowboard binding base so much so that it's two outer edges extend the periphery of the mounting plate 90E in two areas when the axle pivot pin 61 is docked and locked. The longer axle pivot pin 61 construction offers a more robust touring pivot providing more turn response when a rider is connected to the mounting plate 90E riding a ski device. The axle pivot pin 61 in a preferred embodiment is made of metal though any rigid material could carry out the invention in regards to an improved touring pivot axle pin as disclosed herein.

Figure 6:
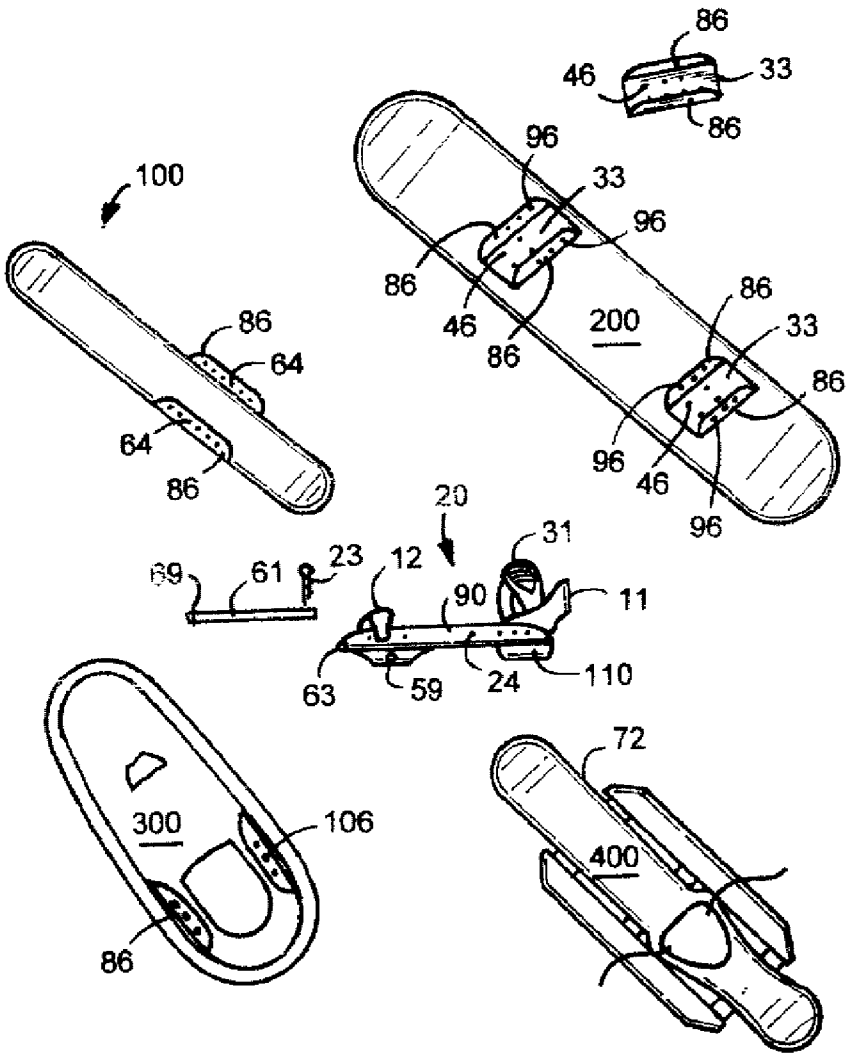
FIG. 6 is a perspective view illustrating a quick-attaching and quick-releasing mounting plate binding with a touring mode and a secondary locked heel mode for use on a snowshoe, touring ski, or a snowboard able to lock directly to the interface with the positional and quick-release pivot pin axle and or a secondary locking element.

FIG. 6 is an illustration of perspective views of the mounting plate 90 and its ability to optionally and selectively connect in a quick-release and quick attaching manner to a group consisting of a ski 100, a snowboard 200, a snowshoe 300, a snowshoe ski hybrid 400 by using the axle pivot pin 61. In one embodiment the axle pivot pin 61 with detachable features including at least one cotter pin 23 and a c-clip 69 or retaining ring 69 connected to the pivot axle pin 61 in one example embodiment. Flanges 86 with docking axle pivot pin 61 holes 96, 64, and 106 may be used on the riding devices. In one embodiment a riding device may consists of climbing and gliding mounting plate positions on one device. In other words the pivot axle pin 61 can be removed from one location climbing mode or travel mode on the device releasing the mounting plate 90 and then the mounting plate 90 is placed in a second position and connected to the same device or separate device for a secondary different travel mode such as sliding.

The snowboard mounting plate 61 interface 33 is mounted to the snowboard 200 with screws, bolts or rivets. The axle pivot pin 61 docking areas 96 lock the mounting plate 61 to the interface 33 in a snowboarding locked heel mode. Axle pivot pin 61 uses position 59 on the mounting plate 90 and can be lined up to docking areas 96 on the snowboard 200 mounting plate 90 interface 33 and the axle pivot pin 61 is pushed into place through both the mounting plate 90 lock position 59 and docking areas 96 in the interface flange 86. The ski 100 has mounting areas for the mounting plate 90 in flanges 86 and axle pin 61 docking areas 64 on the flanges 86. The mounting plate 90 can be attached with its touring axle pivot pin 61 at position 63 with the pivot pin 61 forming a free heel mode for a walking motion or the mounting plate 90 can be attached at a secondary lock system rear of the touring axle position 63 such as axle lock position 59. The axle pivot pin position 59 is a locked pivot mode preventing the mounting plate 90 from articulating in a walking motion. Basically the heel cannot move up and down in a walking motion when axle pivot position 59 is coupled to holes 64 on the ski flange 86.

A snowshoe 300 is pictured with an interface suited to accept the mounting plate 90 by way of axle pivot pin 61 through docking holes 106 on flanges 86. A snowshoe ski hybrid device with the ability to form a ski mode or a snowshoe mode is pictured in 400. It also may contain one or more embodiments of the present invention including the use of the mounting plate 90 in a snowshoe mode, locked heel ski mode, and cross-country ski mode, or touring mode. Additionally, the mounting plate when removed from a device may be used with a cleat forming a crampon system (not shown).

The mounting plate 90 shown in FIG. 6 illustrates the ability for the mounting plate 90 to be universal in that in can attach and reattach to so many devices in so many positions. The straps 12 and 31 may be used in one embodiment for binding soft shelled boots. In another embodiment a step-in system could be utilized in the universal mounting plate 90. Finally, in another embodiment at least one strap could be used mounted to the mounting plate 90.

Figure 7A:
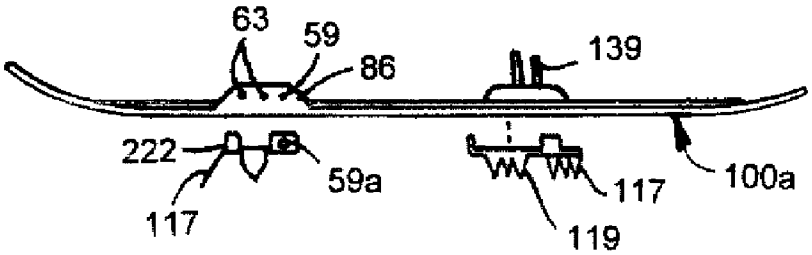
FIG. 7A depicts various views illustrating the mounting plate and quick-release coupling system and at least two mounting plate locking positions on a ski shaped riding device in accordance with the present invention.
Figure 7A:
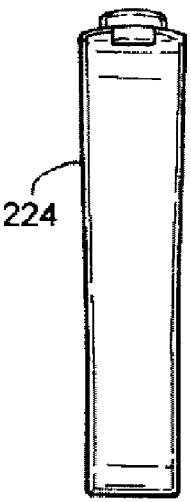
Figure 7A:
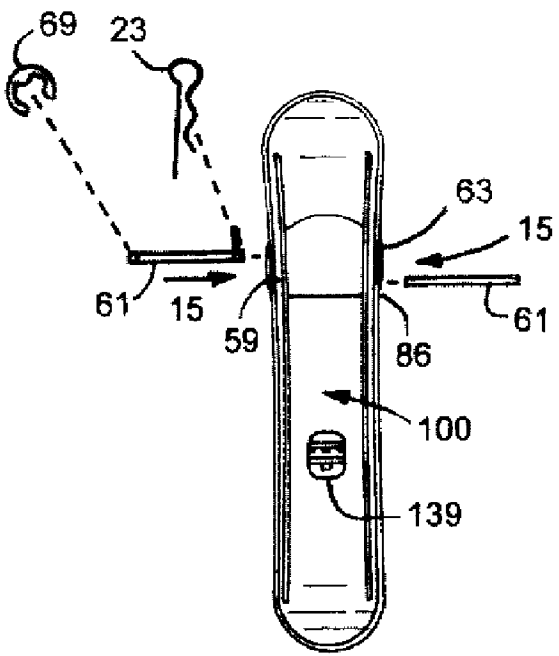
Figure 7A:
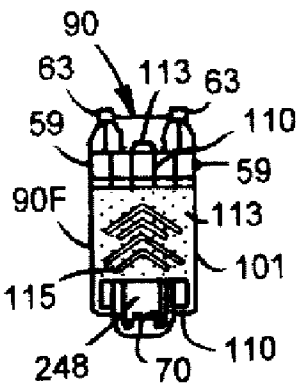

FIG. 7A is a top plan view of the mounting plate 90F, a touring ski 100, the mounting plate 90F, and the axle pivot pin 61. The axle pivot pin 61 uses movement 15 to engage the ski flanges 86 transversely with axle pivot pin 61 docking holes 63 or 59. In a separate embodiment two axle pivot pins 61 could be docked simultaneously in 63 and 59 locking to areas of the mounting plate 90F at the same time. The mounting plate 90F has apertures 113 directly located on surface 101 of the mounting plate 90F where footwear will rest when coupled to the binding system 20. The apertures 101 reduce the weight of the mounting plate 90F especially when constructed of a metal such as aluminum. Between each aperture 113 are rib like structures to maintain a structure. The apertures 113 also allow the bottom surface of the boot (not shown) when mounted to the mounting plate 90F have nothing in there between accept for the boot and the top of a riding device allowing snow to travel through or a separate flat plastic snow repelling device connected to either side of the aperture for keeping snow off of the binding (not shown). In the prior art there is a separate base plate connected to the snowboard binding assembly and binding base.

In one embodiment the mounting plate 90F may have an aperture in the heel region 248 with flange or wall structures around the aperture periphery for structure. This is for reducing weight or helping with lock placement with in the foot bed of the mounting plate which is surface 101 as well as any surface the sole of the footwear makes contact when mounted to the binding top surface. There is a second aperture in the front third portion of the binding plate 90F in FIG. 7 for securing a locking mechanism. So the mounting plate 90F in FIG. 7 contains open window structures through the mounting plate 90F itself which serve various purposes including weight reduction, locking features, and aesthetics. The mounting plate 90F in one embodiment could contain apertures 113 on the foot bed 101 with flanges 115 extending upward from the foot bed 101. Connected to the flanges 115 are at least one resilient strap or straps 12 and 31 for securing a boot to the mounting plate 90F. In a further embodiment the sole of the boot can be seen when attached to the mounting plate 90F with apertures 113. In a separate embodiment the aperture 113 in the mounting plate 90F could be made in various shapes and sizes to carry out its nature of utility existence offering a purpose not yet found on current snowboard touring binding plates in the prior art that utilize a detachable touring pivot in the front half of the binding plate 90F and a secondary locking structure for a locked heel mode rear of the touring pivot.

100*a* touring ski snowshoe hybrid is illustrated with detachable front traction 117 which can attach and quick-release with the axle pivot pin 61 inserted into a plurality of positions including a front touring position 63 and a rear locked heel or pivotal snowshoe pivot 59. The front traction 222 is mounted to pivot dock 59*a* on the traction 117 and 59 on the ski 100 to selectively lock the traction 222 to the underside of the ski 100 with the axle pivot pin 61. Also shown is a rear lock 119 which can also lock to the ski positioned to the underside of the touring ski 100. Front 222 and rear locks 119 also contain spike structures for gaining traction on winter precipitation such as snow and ice. An additional traction component which can be used is a climbing skin 224 can be removably coupled to the ski system shown in FIG. 7 or attached permanently. Finally, in one embodiment a selective heel lift 139 has at least one climbing bar coupled to the top surface of the heel lift to selectively rotate up or down dependent on the users desire of climbing a slope and reduce lower leg fatigue.

Figure 7B:
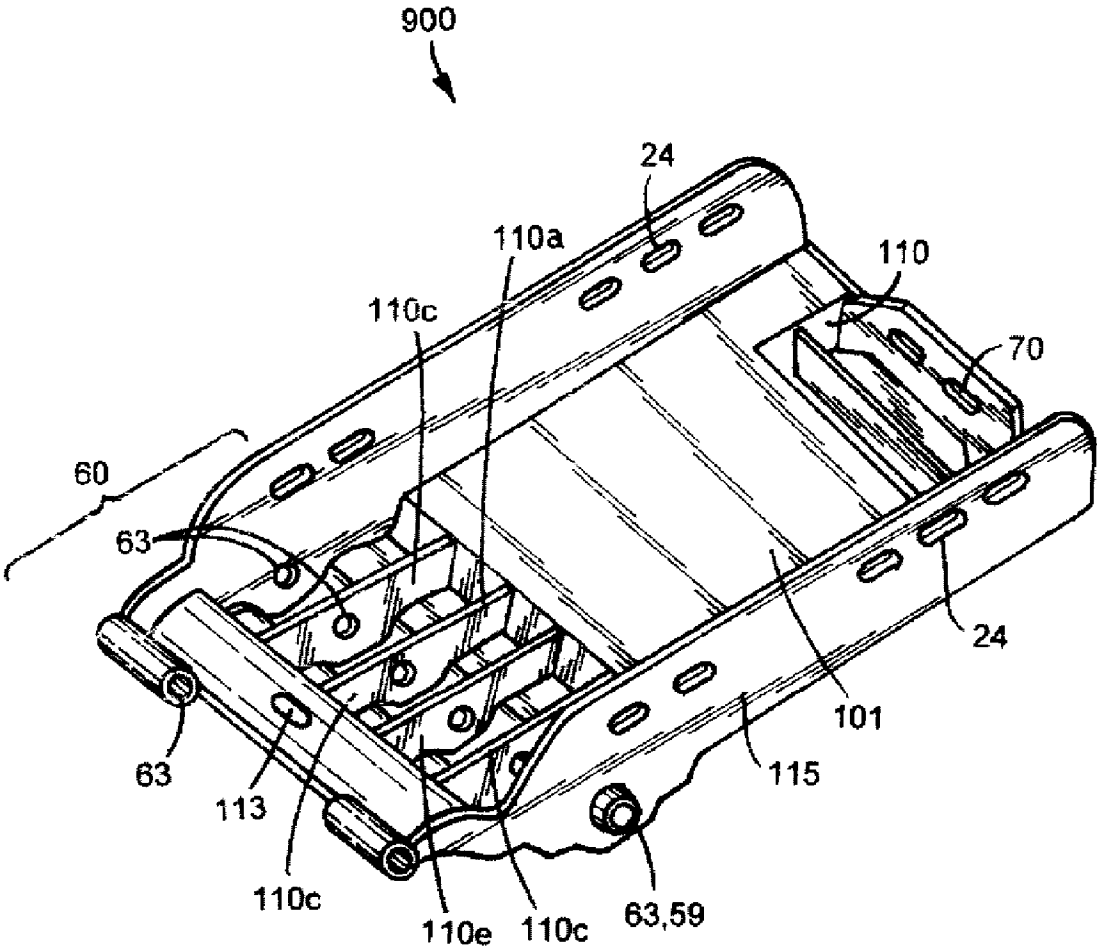
FIG. 7B is a top plan view illustrating the mounting plate with rail structures or flange structures which support the axle pivot pin in accordance with the present invention.
Figure 7C:
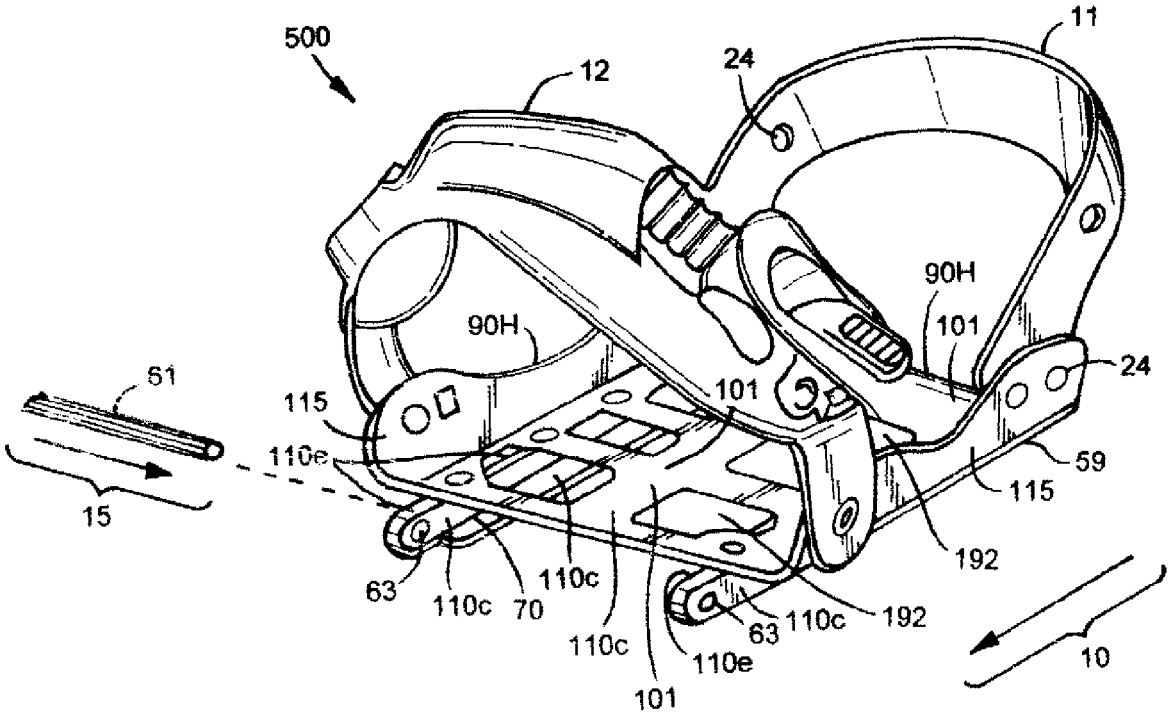
FIG. 7C is a top perspective view of an illustrated mounting plate with rail structures or flange structures which support the axle pivot pin in accordance with the present invention.

FIG. 7B and FIG. 7C are top perspective plan views of the mounting plate 90G in accordance with the present invention. The touring style snowboard/ski binding has a base plate 90G that can directly mount a boot on a portion surface 101 and rails 110 located and connected to the surface 101 with rails 110 supporting a quick-release quick attaching locking component or interface located and connect the locking component such as a axle pivot pin 61 to a separate sliding device such as a ski or snowboard. Rail 110*c* structure portion is in the front half of the mounting plate 90G with touring axle pivot pin 61 docking position 63 which offers a position under the foot bed 101 or footwear sole plane (not shown).

Figure 17:
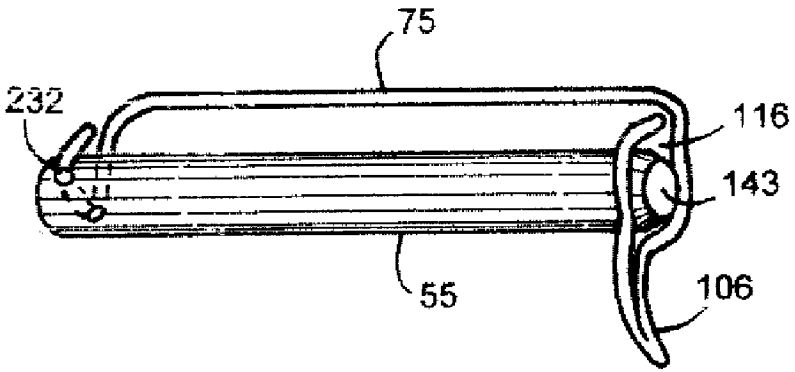
FIG.17 (PRIOR ART)
FIG. 17 is illustrating an axle pivot pin (clevis pin) with one connected locking structure found in the prior art.

In one embodiment the rail 110*e* faces or touches only the sole surface of the boot with no other structures touching a portion of the top surface of the rail 110*e*. At one end of the rail 110*c* in the touring area 60 mounting holes 63 are located for docking and securing axle pivot pin 61. FIG. 17 is another illustration of this embodiment. The foot bed 101 is made higher than at least a portion of the axle pivot pin 61 docking location in the rail 110 allowing footwear to correctly pivot in a walking motion above and over the axis. This system is directly integrated with the mounting plate 90G. Furthermore, in combination with the touring pivot mode 63 is a selective optional locking heel mode 70 integrated into the mounting plate 90G to directly lock to a separate quick release locking component or interface on a sliding device to prevent the mounting plate 90G from pivoting in a walking motion. In one embodiment the top portion of the rail structures 110*e* are not connected or touching any surface but face the bottom of a boot without any other structure there between. The rails 110*c* may be configured to parallel the side wall 115 or the rails 110 may be perpendicular with the walls 115 with a portion of their structure below the plane or surface of the footwear bed 101. The rail 110, 110*c*, 110*e*, can be oriented in any form to carry out the and hold and support the mechanisms of locking and unlocking of the touring pivot pin 61 or portions of the mounting plate 90 in quick release and quick attaching fashion and the heel lock system in accordance with the present invention. It must be noted that the rail structures 110, 110*c*, 110*e* could be added separately to the mounting plate 90G in several different embodiments without leaving the scope of the present invention including separate pieces. Included with the rail design in a separate embodiment are walls or flanges 115 which rise above the foot bed 101 plane to secure straps at strap holes 24 as well as positioning the boot properly on the binding mounting plate 90. In one embodiment the sides 115 do not need flanges or walls but a side surface to place holes 24 (not shown). The mounting plate 90G in FIG. 7A has the ability to selectively tour as well as quick release the touring position at holes 59, 63 in the rails 110 and optional and quickly locking the heel 70 for a locked heel mode 70 if desired. This binding mounting plate 90G is very useful in the back country because it offers a lightweight multiple travel mode device with very little weight. It also offers locking mechanism areas below the foot bed 101 to carry out climb and gliding travel modes for a sliding device.

FIG. 7C shows a mounting plate 90H with pivot axle pin 61 uses a perpendicular motion 15 to side walls 115 to form a transverse axle pivot pin location and lock and unlock the axle pivot pin 61 to the tour hole dock 63 and rails 110. The heel lock is engaged with a parallel motion 10 to side walls 115 or longitudinal motion. Note that all locking mechanisms reside in the rails 110 below the foot bed 101 making sure the boot is above the quick release locks. In a separate embodiment the locks could be positioned above the foot bed 101. Apertures 192 allow mounting plate weight reduction, aesthetics, and allowing some snow to travel through the foot bed 101 instead of sticking to it. The material of the mounting plate 90H in most forms utilizing the technology of the present invention should be made in metal such as aluminum, carbon fiber, plastics, or any material suitable to carry out the present invention. In one embodiment the mounting plate 90H could contain apertures in the foot bed 101 and other parts of the mounting plate 90H and at the same time have upward turned side walls 115 or flanges 115 at the sides of the mounting plate 90H to help contain the boot on the footbed. (see also FIG. 7B and FIG. 14B).

Figure 8:
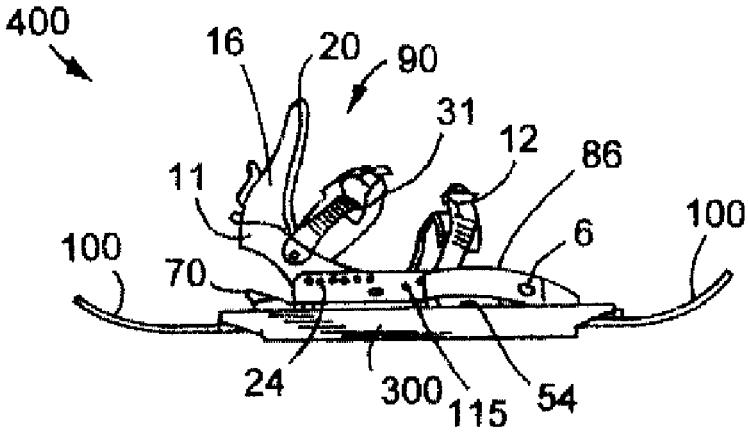
FIG. 8 is a side perspective view illustrating a snowshoe ski/hybrid with a detachable touring axle pivot pin and mounting plate binding assembly and secondary locking heel lock.

FIG. 8 is a snowshoe ski 400 which has three modes of transportation in snow. The first is a sliding device or ski 100 for sliding down inclines when in locked heel mode as well as cross-country free-heel touring mode. There is also a snowshoe mode allowing the binding 20 to pivot through the plane or optional opening of the ski for climbing propulsion. The uniqueness of the snowshoe ski hybrid 400 is the ability its mounting plate 90 possesses in regards to allow selective lock and free heel modes in quick release and attach manner. Additionally, the binding 20 in FIG. 8 is a conventional snowboard binding high back 11, conventional snowboarding binding strap 12 in front and conventional snowboard binding strap in back 31 connected to 115. The mounting plate 90 which 11 and 12 are connected to has features which allow the mounting plate 90 to selectively tour in a walking free heel mode and also ski in locked heel mode. The pivot pin 61 has multiple locations in which to dock the axle pivot pin including 59 and 63 in rails 110. (see also FIG. 9)

Figure 9:
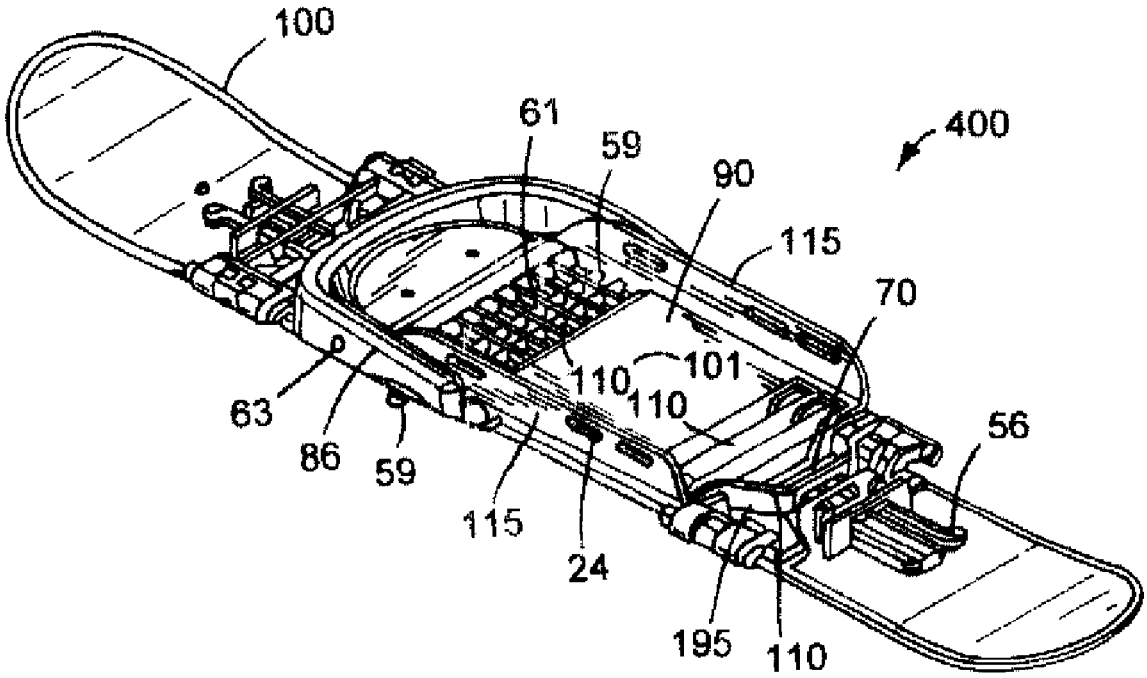
FIG. 9 is a top perspective view illustration of a pivot lock mode on a ski and a secondary locking heel mode accordance with the present invention.

FIG. 9 illustrates a snowshoe ski hybrid device. Important features in connection with the present invention is the top surface of the rails 110 face the boot sole when the boot is present on the mounting plate 90 with no other surface there between. The rails 110 are also attached to foot bed 110 in this embodiment. Pivot pin axes 63 and 59 can also be seen for multiple touring modes and supported by the rails 110. Lock 56 is pushed in a longitudinal motion parallel with flange 115 through rails or flanges 110 to engage and lock the heel of the mounting plate 61. The locking is all accomplished directly to the mounting plate 91 below the sole of the footwear or foot bed 101 in accordance with the present invention including in the box girder 195 below a portion of the foot bed 101. The snowshoe ski hybrid 400 has the ability without the need of separate special separate mounting plates for the mounting plate 90 to connect to and carry out the present invention.

Figure 10:
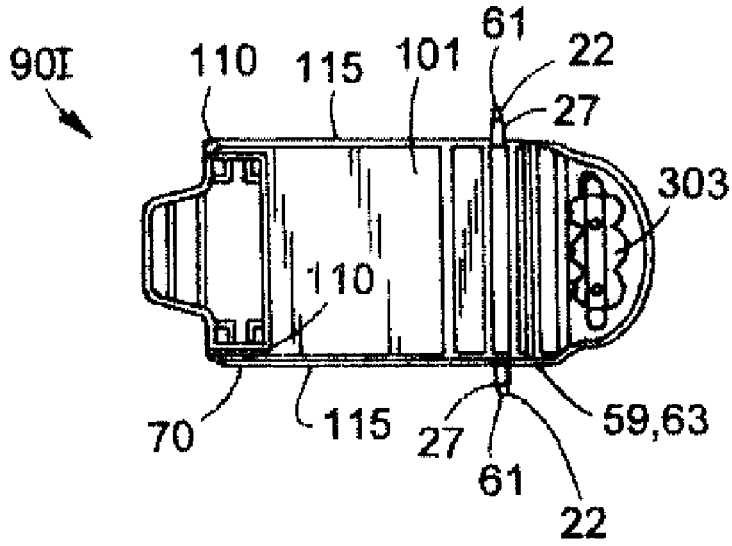
FIG. 10 is an illustration of a bottom view of the binding plate and quick-release axle pivot pin which extends beyond the periphery of the mounting plate surface with the two ends having locking features directly in the design of the axle pivot pin surface area in accordance with the present invention.

FIG. 10 is a bottom perspective view of an embodiment of mounting plate 90I in accordance with the present invention of a climb and glide equipped mounting plate 90. The axle pivot pin 61 is shown extended beyond the periphery of both sides of the mounting plate 90I. Features 22 in the form of a groove or hole on both sides of the axle pivot pin 61 allow attachment of locking features to the ends of the pivot axle for quick-release means so the axle pivot pin 61 can be moved from its position from a touring mode 63 or a secondary mode 59 or 70. In one embodiment C-clips 69 or cotter pins 23 are placed to in position 61 in FIG. 10 to selectively lock the axle pivot pin 61 in its docked position 63 in the mounting plate 90I. Rails 110 can be seen as well as walls 115 for stabilizing footwear on the mounting plate 90I. Rails 110 are connected to the foot bed 101 allowing locks to pass under the foot bed through the rails 110 to connect and disconnect climbing and sliding travel modes.

Figure 11:
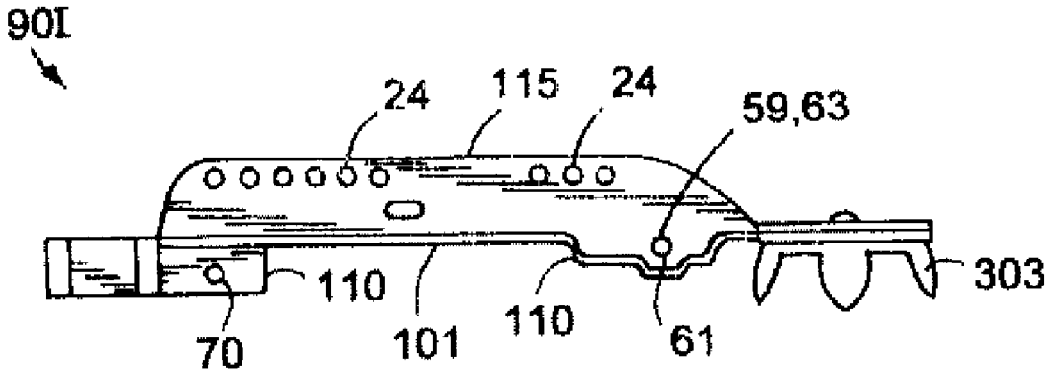
FIG. 11 is a side view illustration an embodiment of a binding mounting plate axle pivot pin direct locking points, flanges, and rails, below the plane of the boot sole in accordance with the present invention.

FIG. 11 is a side perspective view of the mounting plate 90I illustrating the lock hole 70 for an axle pivot pin 61 to be inserted or even a detent clevis pin. Axle dock 63 is shown with the axle pivot pin 61 inserted and docked. Rail or walls 110 are shown below the plane or foot bed 101 of the mounting plate 90I and connected to or extend off portions of the foot bed 101 portion facing the terrain or ground. Flanges 115 are connected to or extend off the top side of the foot bed 101 or same structure which the boot sole makes contact with the mounting plate 90I also shown with strap mounting holes 24 on flanges 115. 303 is optional traction for a snowshoe mode.

Figure 12A:
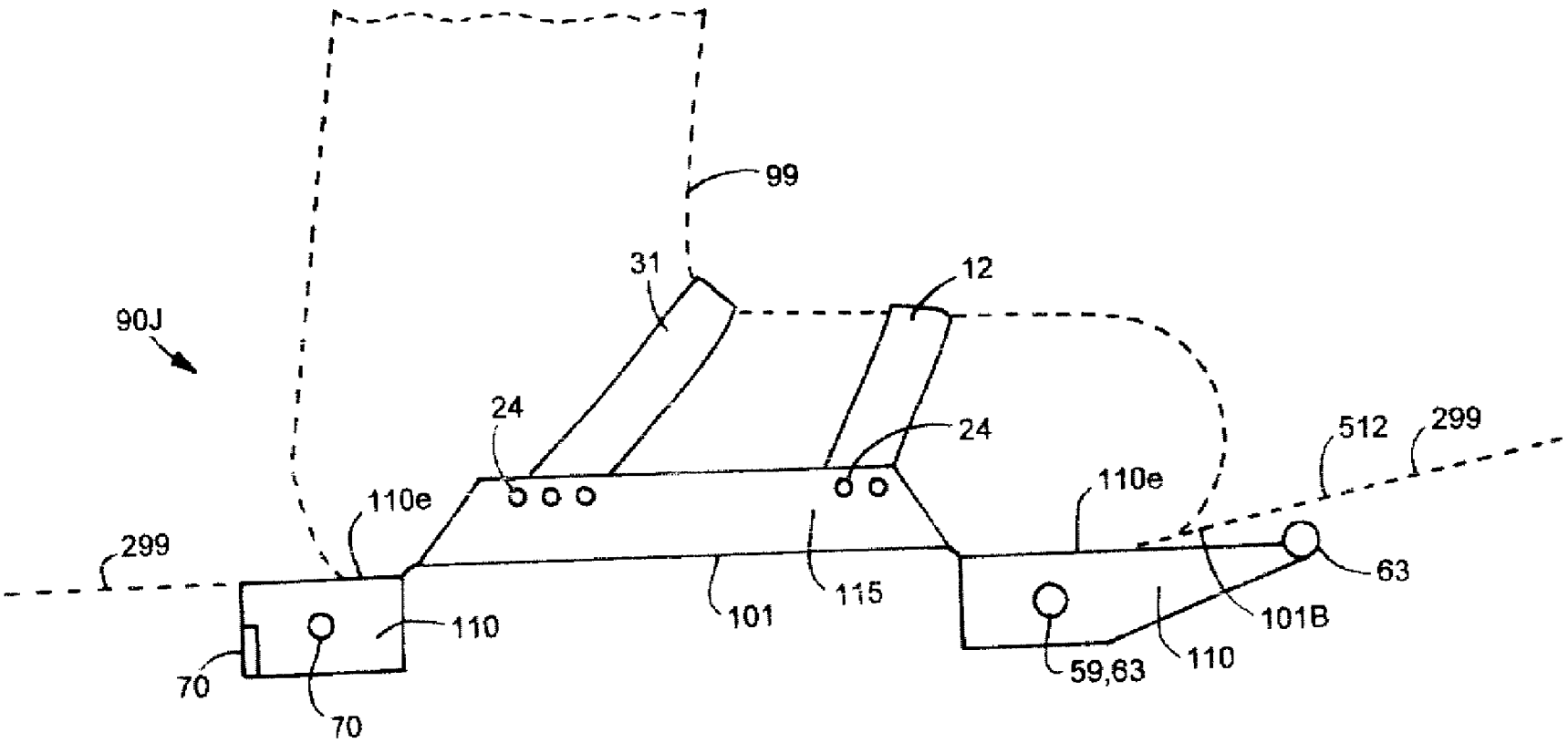
FIG. 12A is a side view illustration an embodiment of a binding mounting plate axle pivot pin direct locking points, flanges, and rails, extending below the plane of the boot sole in accordance with the present invention.

FIG. 12A is a detailed side view of a mounting plate 90J in accordance with the present invention which over comes the draw backs of the prior art. Foot bed 101 supports a boot 99 on at least portions of its surface area directly. Portions of the rails 110 extend off of the terrain facing bottom surface 101 and are connected to the bottom surface of the foot bed 101 of the mounting plate 90J and are below the surface area of the foot bed 101. The rail portion 110*e* or top side of the rail is exposed for the boot 99 to face it directly or touch it in one embodiment. The rail 110 contains locking quick release locking features supported in it's design including pivot hole 63 and locking flange or hole 70 to interact with another quick release locking feature or interface on a sliding or climbing device for winter landscapes such as skis or snowboards. Axle pivot pin 61 can be inserted in lock hole 70 for a locked heel mode and axle pivot pin 61 touring holes 59 and 63 for a touring free heel mode. At the same time the foot bed 101 has up turned flanges 115 which straps can be connected to for restraining a boot 99 on top of the mounting plate 90J. Line 299 represents the boot 99 sole 101B contacting points on the top side of the mounting plate 90J and the locking points all shown below that line connected to the rails or walls 110. Line 299 also represents, in one embodiment, a upward turned front portion of the mounting plate 90J. It must be noted that in a separate embodiment the two rails on either side of the binding plate 90J could be touching each other in other words the void between the two rails could be filled in with material constituting a solid block (not shown). The boot 99 In a separate embodiment the straps 12 and 31 could easily be connect to a side portion of the mounting plate 90J to connect the straps 12 and 31 at holes 24 with screws or bolts or rivets and applicable connected structures.

In a separate embodiment the mounting plate 90J shown in FIG. 12A could be one piece of material with a foot bed 101 portion with at least two side rails 110 or flanges 110 bent downward from the foot bed 101 surface. Flanges 110 include locking areas in the surface area. Flanges or walls 115 are bent upward from the foot bed 101 and have holes 24 for mounting at least one strap or straps 12 and 31. In a further embodiment line 299 is the line the foot bed 101 follows in the front of the mounting plate 90J to further secure the boot 99 from forward motion on the mounting plate 90J.

In another embodiment in accordance with the present invention it would be obvious to make the touring mode 63 equipped rails 110 as separate pieces and connected them to at least a portion the foot bed 101 underside and extending off of the foot bed 101 underside portion on the mounting plate 90 opposite the side the boot 99 rests upon with portions the foot bed 101 underside still directly facing the terrain between the rails. Also included in this embodiment are features which lock the heel portion of the mounting plate 90J binding into place in its mounted position. (see also FIG. 12B)

Figure 12B:
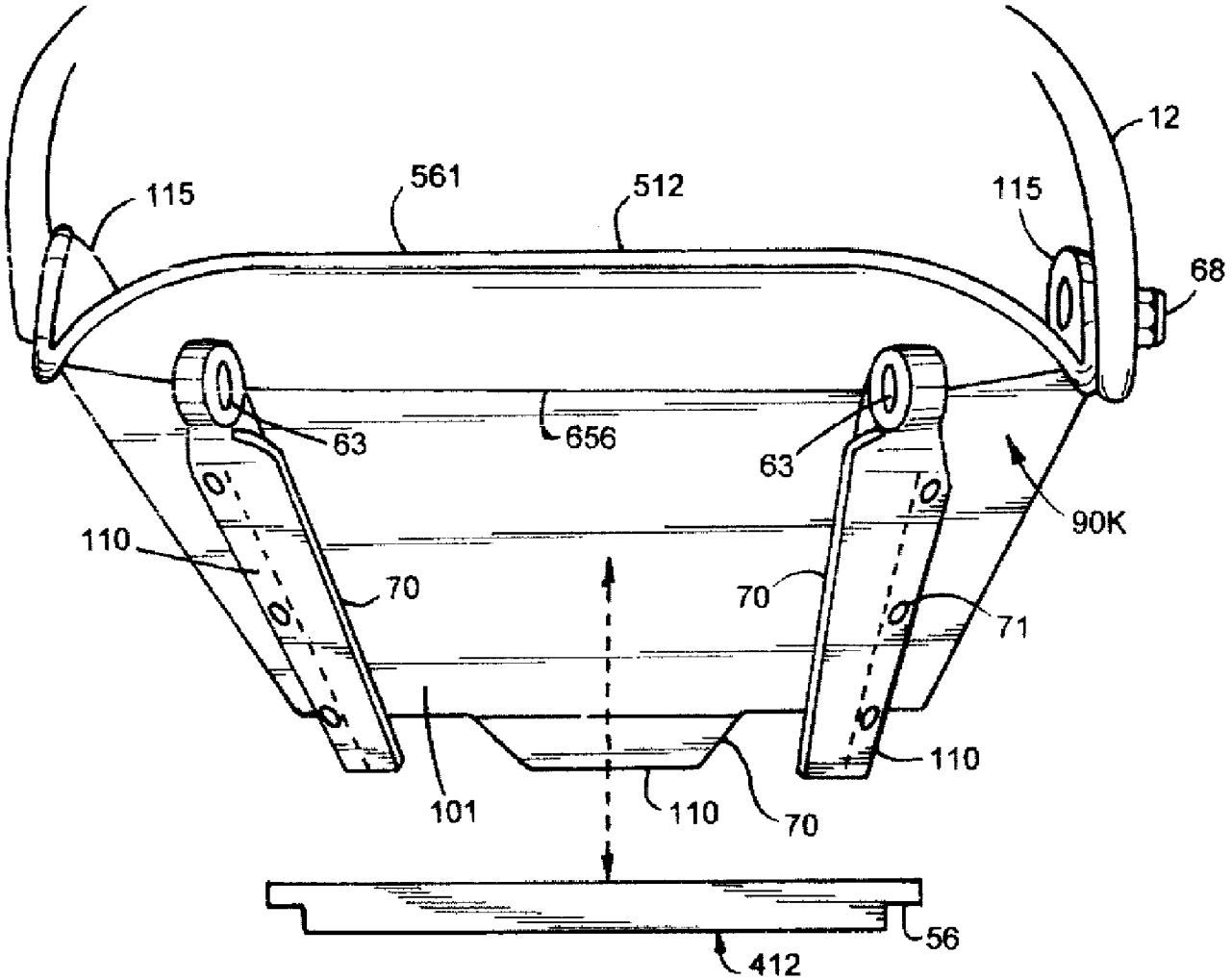
FIG. 12B is a bottom perspective view illustration and embodiment of a binding mounting plate axle pivot pin direct locking points, flanges, and rails, connected to the foot bed in accordance with the present invention

FIG. 12B is bottom perspective view of a mounting plate 90K in accordance with the present invention which over comes the draw backs of the prior art. Foot bed 101 supports a boot 99 on at least portions of its surface area directly. Portions of the rails 110 are ground or terrain facing from bottom surface 101 and are connected to or extend from the bottom surface of the foot bed 101 of the mounting plate 90K and are below the surface area of the foot bed 101. The rail portion 110*e* or top side of the rail is partially exposed with top portions not touching or connected to any object. The rail 110 contains locking quick release locking features in its design at pivot hole 63 and locking flange or hole 70 to interact with another quick release locking feature on a sliding or climbing device interface for winter landscapes such as skis or snowboards. Axle pivot pin 61 can be inserted in lock hole 70 for a locked heel mode and axle pivot pin 61 touring holes 59 and 63 for a touring free heel ski mode. At the same time the foot bed 101 has up turned flanges 115 extending its sides which straps can be connected to for securing a boot 99 on top of the mounting plate 90K. It must be noted that in a separate embodiment the two rails on either side of the binding plate 90K could be touching each other in or in other words the void between the two rails could be filled in with material constituting a solid block. (not shown). The boot 99 In a separate embodiment the straps 12 and 31 could easily be connect to a side portion of the mounting plate 90K to connect the straps 12 and 31 at holes 24 with screws or bolts or rivets and applicable connected structures.

In a separate embodiment the mounting plate 90K shown in FIG. 12A-B could be one piece of material with a foot bed 101 portion with at least two side rails 110 or flanges 110 bent downward from the foot bed 101 surface. Flanges 110 include locking areas in the surface area. Flanges or walls 115 are bent upward from the foot bed 101 and have holes 24 for mounting at least one strap or straps 12 and 31. In a further embodiment line 299 is the line the foot bed 101 follows in the front of the mounting plate 90K to further secure the boot 99 from forward motion on the mounting plate 90K.

In another embodiment in accordance with the present invention it would be obvious to make the touring mode 63 equipped rails 110 as at least two separate rail pieces and connected them to at least a portion the foot bed 101 underside on the mounting plate 90K opposite the side the boot 99 rests upon with all center portions the foot bed 101 underside still directly facing the terrain between the rails. Also included in this embodiment are features which lock the heel portion of the mounting plate 90 into place in its mounted position. (see also FIG. 12A)

Block 412 has rail grooves 56 which interact with rails 110 to form a locked heel locking mechanism 70 in accordance with the present invention. The rails 110 use slide into feature 56 locking the mounting plate 90K directly to the interface. The axle pivot pin 61 is also repositioned from the touring free heel interface to the slider block 412 interface.

The front portion of the mounting plate 90K is shown with an upward turned feature 512 with a bend 656 off of the foot bed 101 also shown. The upward turned feature 512 at the front of the mounting plate 90K helps keep the boot from moving off the mounting plate 90K and offers further stability.

Figure 13A:
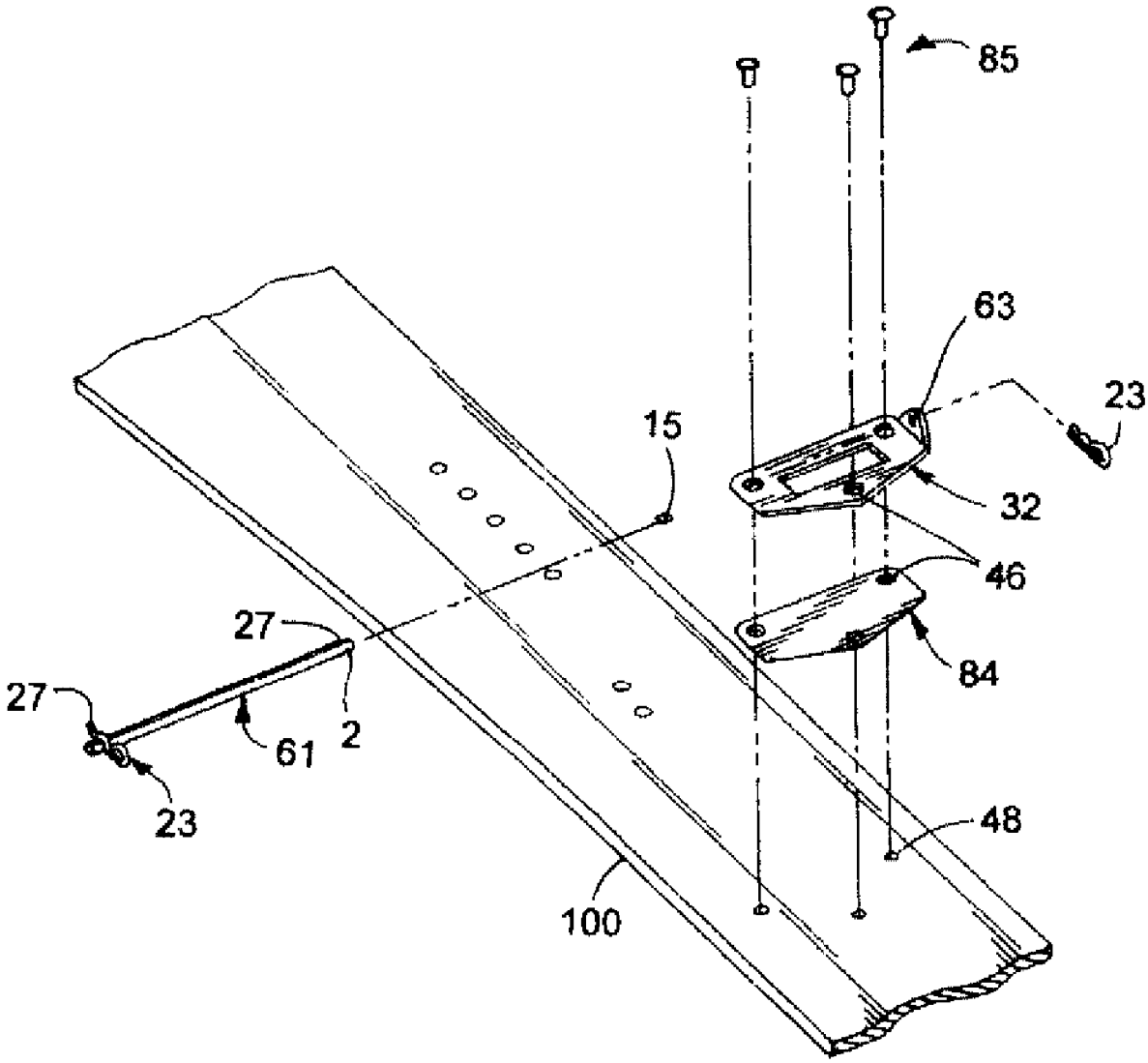
FIG. 13A is an illustration of a removable quick-release pivot axle pivot pin with axle pivot pin locking points on either side of the axle pivot pin on a touring ski binding interface assembly.

FIG. 13A is a top perspective view of the axle pivot pin 61 and mounting components for a touring ski 100 interface 32. The axle pivot pin 61 is shown with its locking feature two ends 27 including grooves or holes or anything suitable to carry out the invention with selective coupling objects such as cotter pins 23 and c-clips though it would be obvious in light of the present disclosure to utilize any quick release coupling object together with a second coupling object on the opposite end of the axle 61. According to one embodiment the coupling mechanisms are connected at "both" sides of the releasable axle pivot pin 61 in features such as grooves, threads, holes, etc formed into the axle pivot pins surface area ends with at least one of the coupling mechanisms being quick-release and quick attaching such as the cotter pin 23 or any other coupling part. In another embodiment one coupling feature at the end of the axle pivot pin 61 is in the form of a c-clip (see FIGS. 6, 7, and 10). Touring ski interface 32 is mounted to the top surface of the ski 100 with bolts or screws 85 placed through holes 46 and into holes 48 on the ski 100.

FIG. 13B is a top perspective view of a ski touring interface 32 with mounting holes 46 for bolts or screws or rivets to be inserted through and holes 63 on the mounting plate 90, said interface 32 connected to a sliding device such as a ski. The axle pivot pin 61 has locking features 27 on both sides of the axle pivot pin 61 to hold the axle pivot 61 pin when it is locked into position in holes 64 on the interface 32. In a separate embodiment the locking features 27 may use a cotter pin 23 or a c-clamp 69 in accordance with the present invention. When the axle pivot pin 61 is inserted into position 64 on the interface 32 its two ends 21 including the locking features 27 extend beyond the periphery of flanges 86.

Figure 14A:
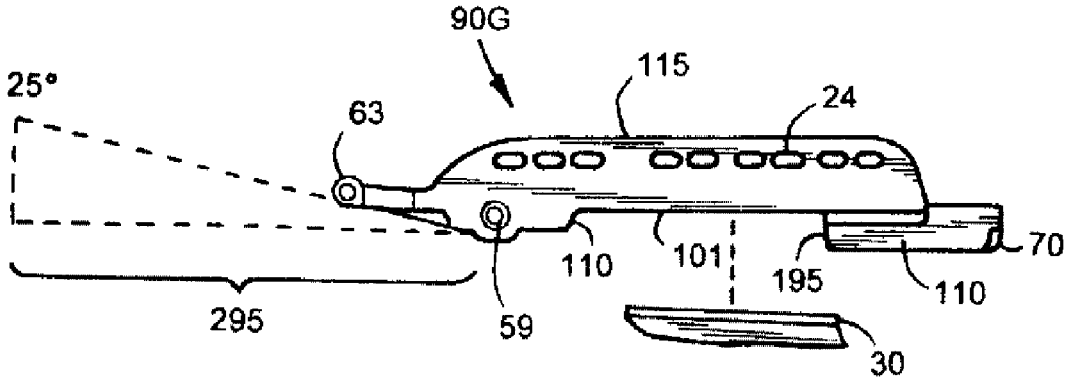
FIG. 14A is one embodiment illustrating foot bed positions, rail, positions, flange positions, for a mounting plate binding with a snow repellant piece in accordance with the present invention.

FIG. 14A is a side view perspective of the mounting plate 90G in accordance with the present invention illustrating the upward bend angle 295 of the front portion of the mounting plate 90G shown with a bend angle of 25 degrees of the main foot bed 101. This feature helps retain a mounted boot and it's forward movement on the mounting plate 90G. Locking areas for touring modes are shown in axle pivot pin 61 docking area 63 allowing the mounting plate to articulate at a specific toe region in a free heel touring mode. Axle pivot pin 61 docking hole 59 is shown as a locked heel pivot mode if the mounting plate 90G is resting on a ski base. If the mounting plate 90G is connected to a snowshoe then the docking hole 59 axle 61 position allows an additional articulating free heel touring mode. In a further embodiment locking areas may include a heel portion lock 70 connected to a box girder structure 195 at the rear of the mounting plate 90G. The box structure 195 is a series of flanges 110 connected to one another and part of the foot bed 101. Snow shield 30 is a separate piece which can be permanently affixed to the mounting plate 90G to prevent snow from sticking to the underside of the mounting plate 90G. The snow shield 30 can also be placed on other portions of the mounting plate 90G to serve the same purpose. It must be noted that the mounting plate 90G can have permanently connected structures affixed to its surface area to supply strength or separate binding and mounting plate 90G functions.

Figure 14B:
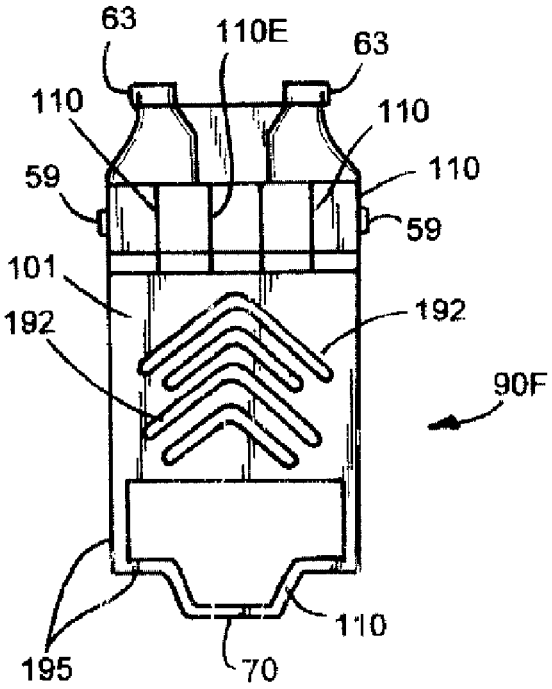
FIG. 14B is a top perspective view of the selective touring mounting plate with apertures in the foot bed accordance with the present invention.

FIG. 14B is a top plan view of the mounting plate 90F in accordance with the present invention. Locking areas for touring modes are shown in axle pivot pin 61 docking area 63 allowing the mounting plate 90F to articulate at a specific toe region in a free heel mode. Axle pivot pin 61 docking hole 54 is shown as a locked heel pivot mode 70 if the mounting plate 90F is resting on a ski base. If the mounting plate 90F is connected to a snowshoe then the docking hole 59 axle position allows an additional freeheel articulating touring mode. In a further embodiment locking areas may include a heel portion lock 70 connected to a box structure 195 at the rear of the mounting plate 90F. The box structure 195 is a series of flanges or at least one flange 110 connected to one another and part of the foot bed 101. It must be noted that the mounting plate 90F may have permanently connected structures affixed to its surface area to supply strength or separate binding and mounting plate 90F functions. In one embodiment apertures 192 can be added on the foot bed 101 to reduce weight, locking structure can move through, add aesthetics, and create an open window through which snow can move. Apertures 192 also provide grip for a mounted boot to keep it more stable on the mounting plate 90F. (also see FIG. 7C)

Figure 14C:
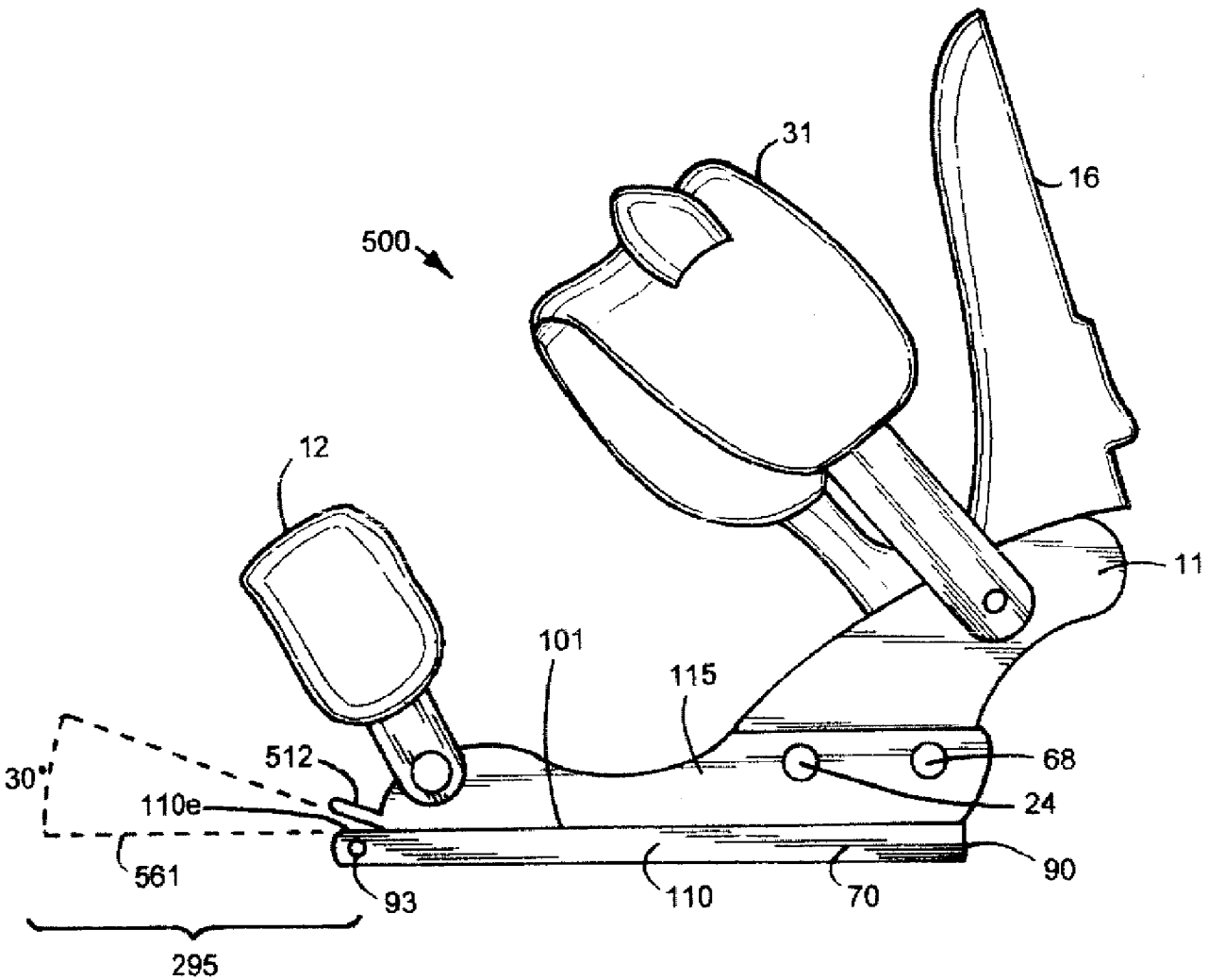
FIG. 14C is a side perspective view of the selective touring mounting plate with straps connected to the mounting plate and a separate embodiment of the foot bed position in the front half of the mounting plate.

FIG. 14C is a side perspective view of one embodiment of the mounting plate 90K in accordance with the present invention or the full snowboard touring binding assembly 500 intergraded and connected to one mounting plate 90K without the need of a snowboard binding base plate or separate mounting plate. The design includes an upward turned foot bed 101 portion 512 at the front touring area 60 of the mounting plate 90K which may be up turned from 1 degree to as much as 90 degrees off set the foot bed 101 to facilitate it's use which is making boot more stable on the mounting plate 90K and limits forward movement of the boot when mounted to the mounting plate 90K with at least one strap or strap portion 12 and strap portion 31. The design also includes a touring pivot 63 for a free heel mode in which the axle pivot pin 61 can dock in a selective quick release and quick attach manner in wall or rail 110. Flange or rail 110 is connected to and extending from the foot bed 101 of the snowboard binding 500 with top rail portion 110E not connected or touching another surface. Also included in the mounting plate 90K is the heel lock 70 located in wall or rail 110. (see FIG. 14A)

Figure 15:
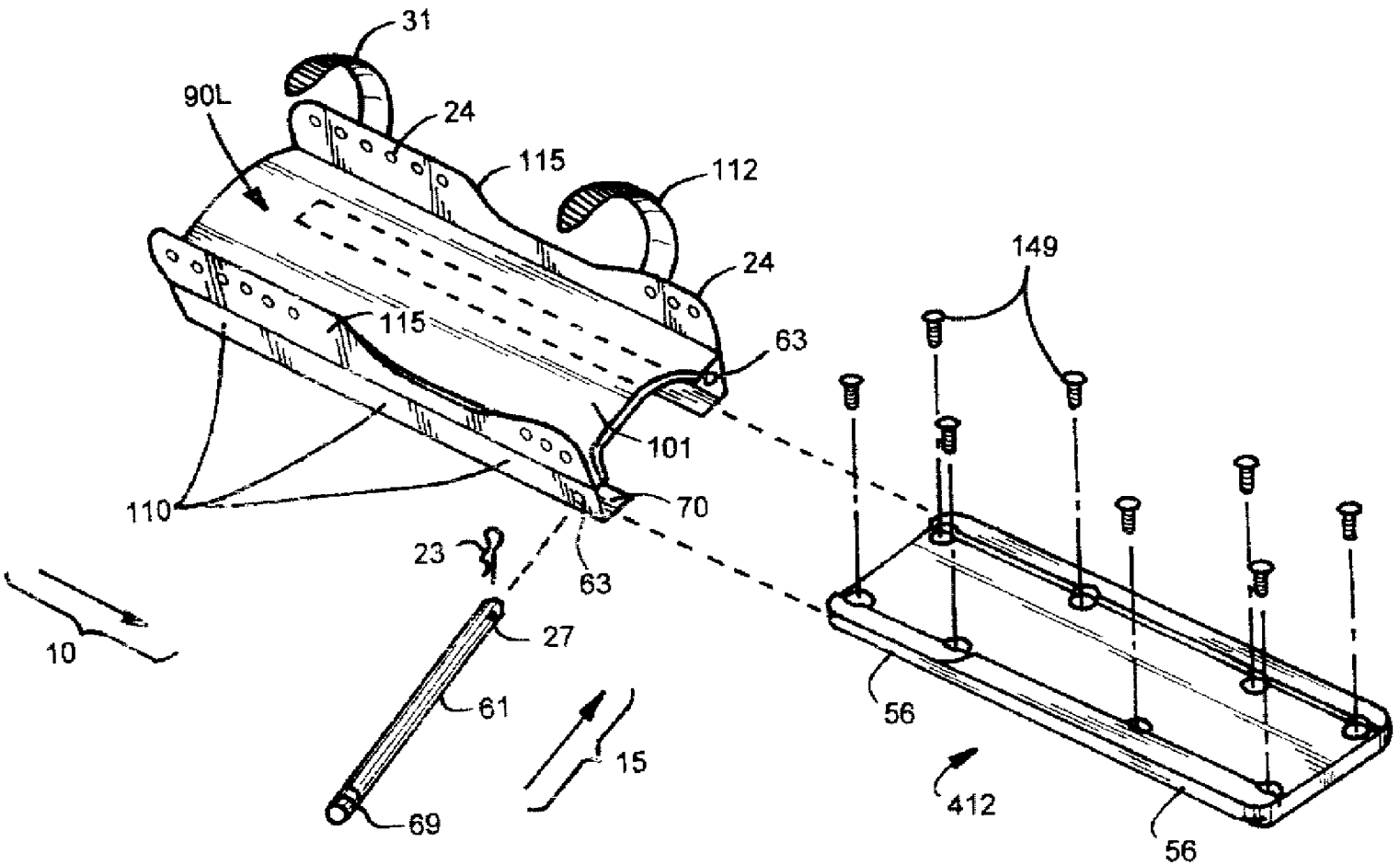
FIG. 15 is one embodiment illustrating a selective touring mounting plate binding with a quick-release touring pivot and secondary locking means in accordance with the present invention.

FIG. 15 is a top perspective view of a mounting plate 90L in accordance with the present invention comprising a foot bed 101 with upward turned flanges 115 on the sides of the foot bed 101. Flanges 115 suspend the mounting holes 24 for the mounting of at least one strap 112 to the flange 115. Touring pivot 63 contained and supported within the rail, rib, or wall 110 holds and supports the axle pivot pin 61. Locking feature 70 holds the mounting plate 90L to locking feature 56 on the slider block 412. The innovative step in the mounting plate 90L or soft boot binding assembly 90L with straps attached thereto is its ability to attach to the slider block 412 without the use of separate mounting plates over coming too much weight and expense. In accordance with the present invention the mounting plate 90L has a quick-release tour pivot axle 61 and multiple "direct" quick release locking docks or points under the foot bed 101 not found in the prior art and eliminates the use of bolts to anchor a snowboard binding assembly and binding base to a separate mounting plate saving money weight and time and at the same time increasing performance of the binding system for touring and sliding. The slider block 412 is coupled to a sliding device with screws 149. Axle pivot pin 61 is used to lock and unlock the free heel touring mode.

Figure 16:
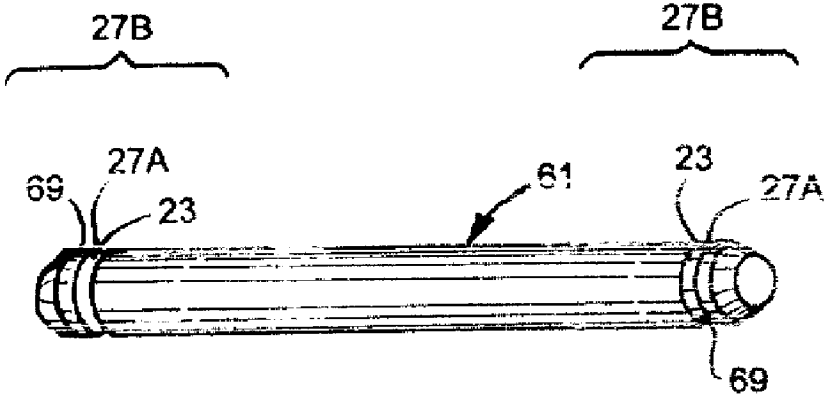
FIG. 16 is one embodiment illustrating an axle pivot pin with two connected locking structures in accordance with the present invention.

FIG. 16 is a side plan view of a mounting axle pivot pin 61 in accordance with the present invention. The axle pivot pin 61 is a long slender rod piece with two ends. On both ends there is a coupling feature 27 for allowing the axle pivot pin 61 to selectively and universally lock in an axis or axes on a mounting plate 90 and or rails 110 or flanges 86 (also see FIG. 6) and be connected to a snowboard, ski, or snowshoe device. The feature on the axle pivot pin 61 which allows coupling devices is material removed from the axle to allow a coupling feature connection thereto. In one embodiment the coupling devices are from a group consisting of cotter pin, c-clip, or nut etc. It would be obvious with one skilled in the art in light of the present disclosure to construct an axle pivot pin 61 with coupling features on both ends of the axle pivot pin 61 with one at least one end of the axle pivot pin 61 having release ability and use other embodiments not mentioned herein to create or fabricate a quick release of at least one axle end without leaving the scope of this particular invention of a releasable touring pivot axle pin 61.

The benefit of having the coupling parts of the axle pivot pin 61 at both ends is its ability to be made longer and span transversely a further surface of a mounting plate offering more strength. It also allows the pin to be arranged in more than one axis or locking dock more efficiently. The axle pivot pin 61, in one embodiment, is made of steel or other metal materials and could also be made of any other materials to carry out the invention.

FIG. 17 is a pivot pin found in the prior art. The axle pivot pin 55 found in the prior art is cumbersome in that it requires a clasp to be anchored at one end. This prevents the axle pivot pin 75 from mounting to more than one axis because the clasp will not fit through the axis holes such as axis 59 on the mounting plate 91 or a heel lock 70 using the axle 61. Furthermore it is a shorter length spanning axle and offers less support when anchoring a mounting plate 90 to a sliding device.

Figure 18:
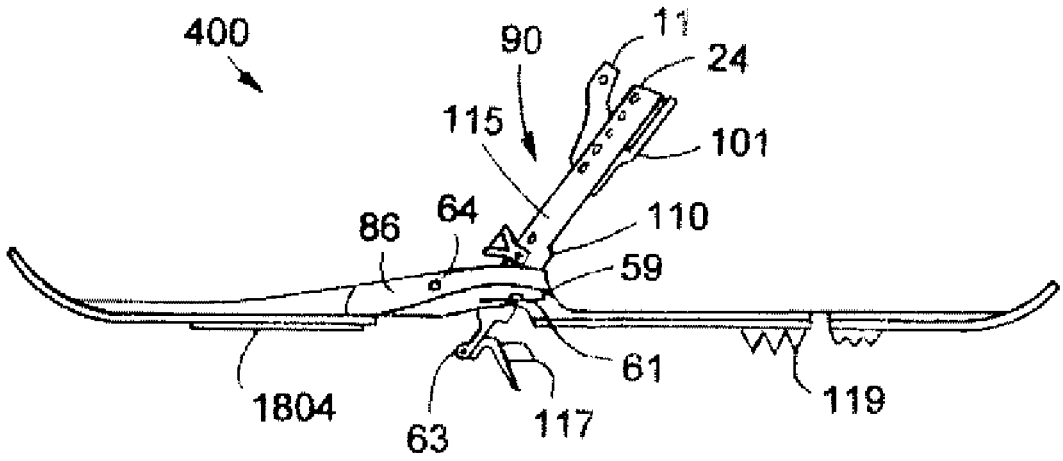
FIG. 18 is an embodiment illustrating the mounting plate binding connected to a snowshoe/ski hybrid touring mode in accordance with the present invention.

FIG. 18 is a side perspective view of the snowshoe ski hybrid 400 in a touring ski mode with the mounting plate 90 of the present invention. The mounting plate 90 has a touring pivot 63 which lines up with touring mount hole 64 on flange 86. The mounting plate 90 is shown articulating in a free heel mode on axle pivot pin 59 on a snowshoe type touring device. Detachable cleat 117 is shown connected to the mounting plate 90. In one embodiment a second axle pivot pin 61 is inserted and docked into touring pivot pin dock 63 at the same time a second axle pivot pin 61 is inserted into touring pivot dock 59 forming a locked heel configuration. The mounting plate 90 has quick release axle pivot pin 61 locking features below the foot bed 101. The flange or rail 115 has strap mounts 24 for securing strap systems. 1804 is a movable wing which opens and closes the ski surface to change from snowshoe to ski modes allowing the binding to rotate through the device or not. Traction component 119 is removably coupled to the snowshoe ski hybrid 400 to offer further traction.

Figure 19:
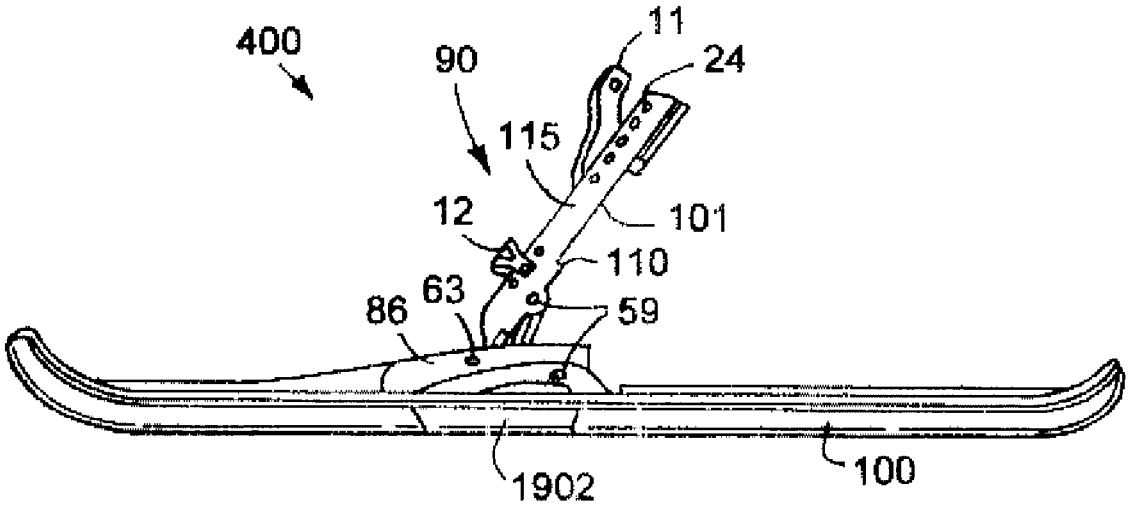
FIG. 19 illustrates the mounting plate binding in ski touring or cross-country telemark mode in accordance with the present invention

FIG. 19 is a side perspective view of the snowshoe ski hybrid 400 in a touring ski mode with the mounting plate 90 of the present invention. The touring pivot axle 63 is shown coupling the mounting plate 90 to the ski flanges 86 allowing a free heel walking motion. Secondary locking position 59 is shown in an open position allowing the heel to move freely in the walking motion. If a second axle pivot pin 61 is docked in position 59 on the ski then the mounting plate 90 or articulation walking mode will be stopped and locked. Thus we see that the snowshoe ski hybrid shown in FIGS. 18-19 has a releasable touring pivot by way of pivot axle pin 63 and secondary separate locking features 59 rear of the touring pivot 63 and a lock below the foot bed 101 all in the same mounting plate 90 which also includes at least one strap 12 mounted to the side of the mounting plate 90 to secure a boot on top the foot bed 101. Climbing and gliding is achieved by one mounting plate 90. Wing 1902 is shown forming a ski surface and plugging the snowshoe mode window for which the mounting plate 90 may optionally pivot through in the snowshoe mode as depicted in FIG. 18.

Figure 20:
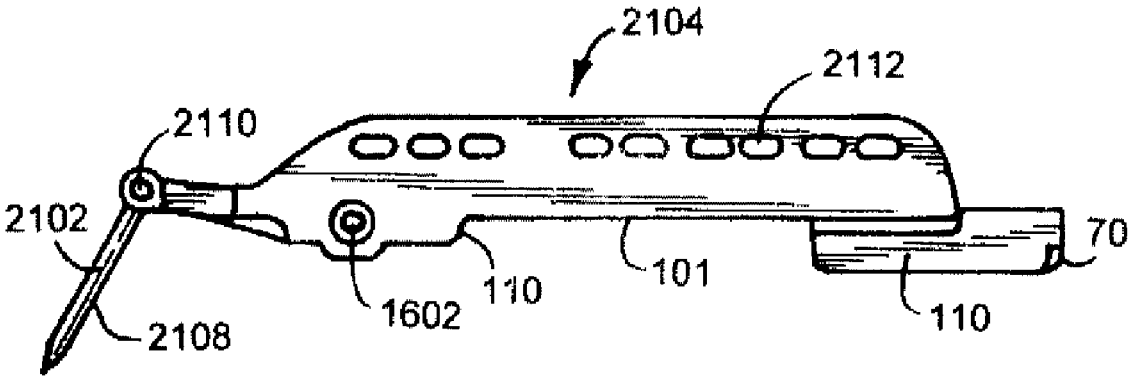
FIG. 20 illustrates side view of an embodiment of the mounting plate with recessing traction in accordance with the present invention.
Figure 21:
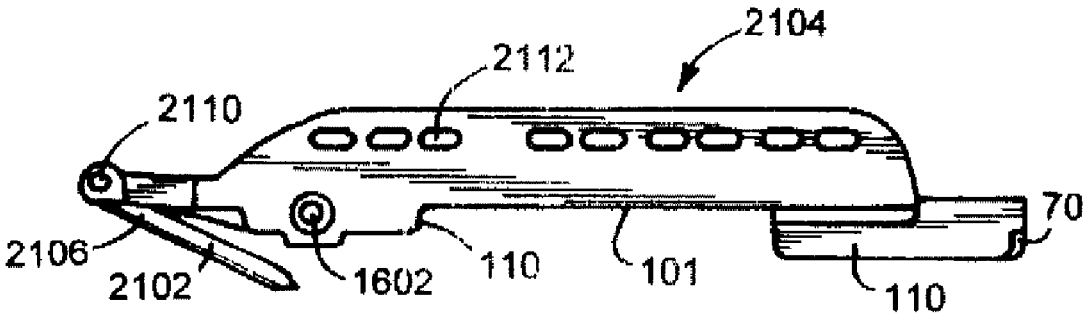
FIG. 21 illustrates side view of an embodiment of the mounting plate with recessed traction in accordance with the present invention.

FIG. 20-21 is a side perspective view of a mounting plate 2104 in accordance with the present invention. The mounting plate 2104 includes a touring pivot dock 2110 for a quick releasable axle pivot pin 61 (not shown). A secondary pivot dock 1602 is shown rear of the touring lock position 2110. Pivot dock is where axle pivot pin 61 can be inserted through a flange 86 connect to a ski or snowshoe device and the hole 1602 or 2110 to secure an axle pivot pin 61. Axle pivot pin position 1602 provides a free heel snowshoe pivot position or a locked heel position dependent on what the user desires a climbing or sliding mode. A third lock position is shown in heel lock feature 70. The mounting plate 90 locking points 1602 and 70 are found behind the touring pivot 2110. Walls or rails 110 show lock supporting positions within the side rails or walls of 110 and below the foot bed 101 in accordance with the present invention though it has been explained that in a separate embodiment the locking positions could be above the foot bed 101.

In one embodiment deployable 2108 traction spike and retractable 2106 traction spike 2102 can be utilized on the mounting plate 2104 for the snowshoe mode and also a detached mounting plate 2104 from the riding device mode or crampon mode.

Figure 22:
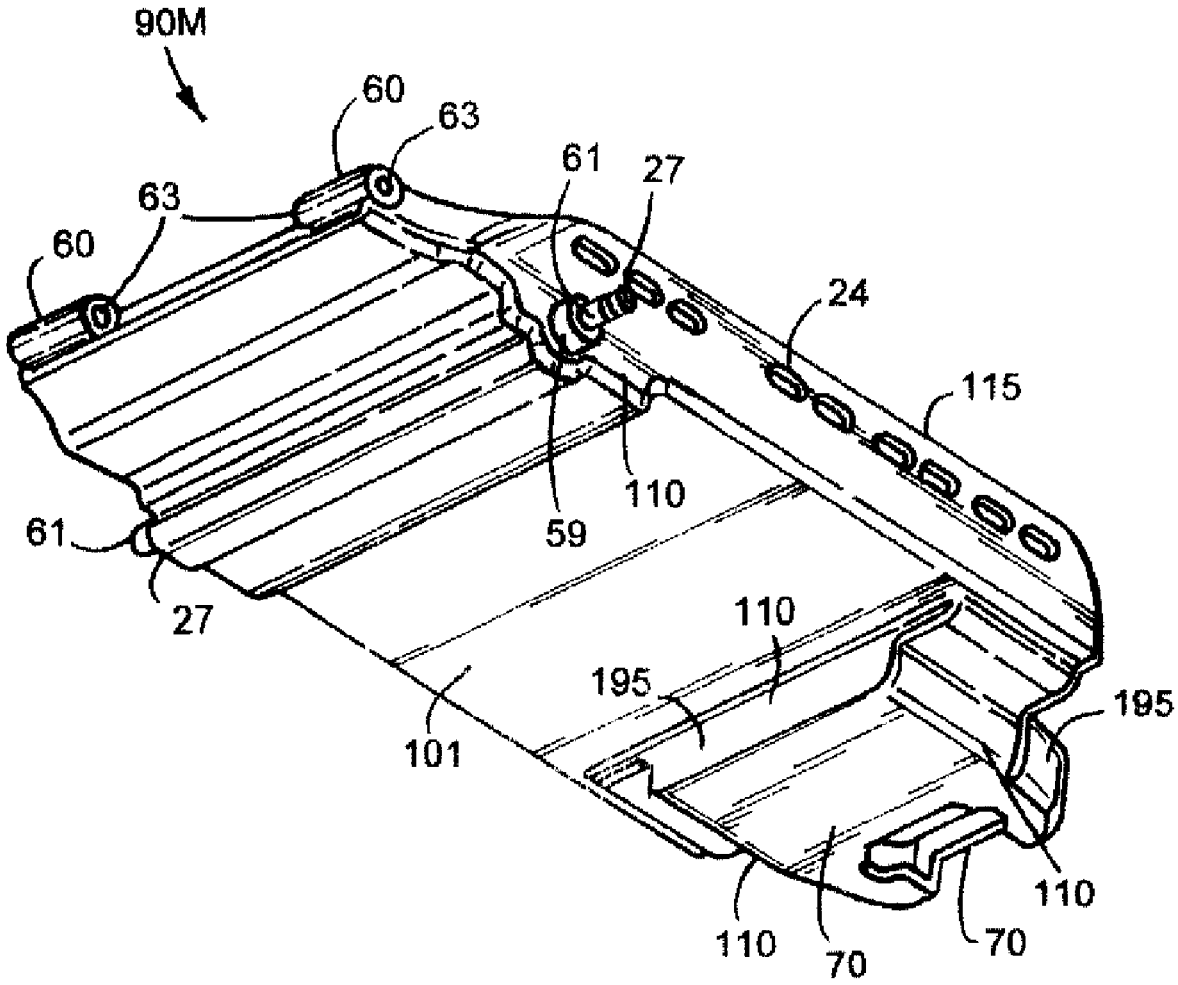
FIG. 22 is a bottom perspective view illustrating the multiple locking points for free heel and locked heel travel modes including a box girder structure for supporting the locking structures on the bottom side of the mounting plate in accordance with the present invention.

FIG. 22 is a bottom perspective view of an embodiment of the mounting plate 90M in accordance with the present invention of a climb and glide equipped mounting plate 90M able to transition articulating pivot modes and lock heel modes quick-release style directly on the mounting plate 90M surface area without the need of interfaces or extra base plates and multiple stacked bolted parts. The axle pivot pin 61 is shown extended beyond the periphery of both sides of the mounting plate 90M. Features 27 may be in the form of a groove or hole on both sides of the axle pivot pin 61 allow attachment of releasable locking features to the ends of the pivot axle 61 for quick-release means so the axle pivot pin 61 can be moved from its position from a touring mode 63 or a secondary mode 59 or 70. In one embodiment C-clips 69 or cotter pins 23 are placed to in position 27 to selectively lock the axle pivot pin 61 in its docked position 63 or 59 in the mounting plate 90M. Rails 110 can be seen stabilizing or supporting the locking mechanisms 70, 59, below the foot bed as well as walls 115 for stabilizing a boot on the mounting plate 90M. Rails 110 are connected to and under the foot bed 101 or extend from the foot bed 101 allowing locks to pass under the foot bed through the rails to connect and disconnect climbing and sliding travel modes.

Figure 23:
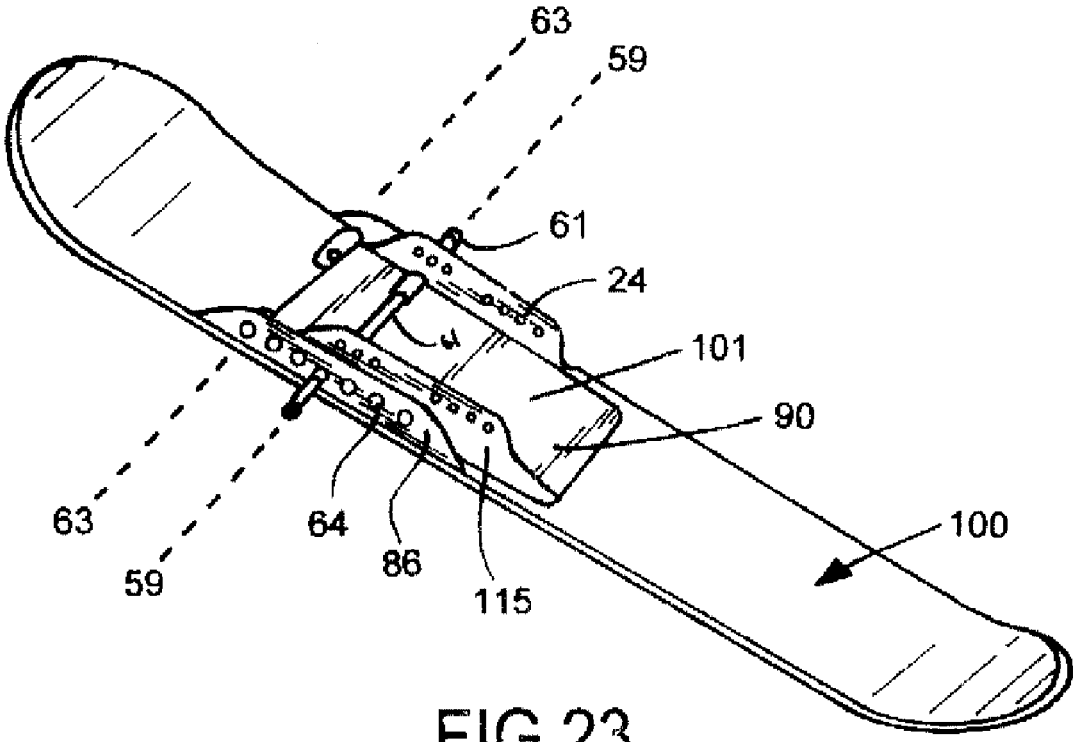
FIG. 23 is a top perspective view illustrating a selective touring ski device with the mounting plate binding attached in locked heel position in accordance with the present invention. The touring mode on the mounting plate binding is also shown "unlocked" in the illustration.

FIG. 23 is a top perspective view of a touring ski in accordance with the present invention. Mounting plate 90 is shown anchored to the ski binding interface 64 of a ski 100 with axle pivot pins 61 in rear docking slot 59 offering a locked heel sliding mode. When the axle pivot pin 61 is transferred to slot dock 63 the mounting plate is able to pivot in a free heel walking motion about axis 63.

Figure 24:
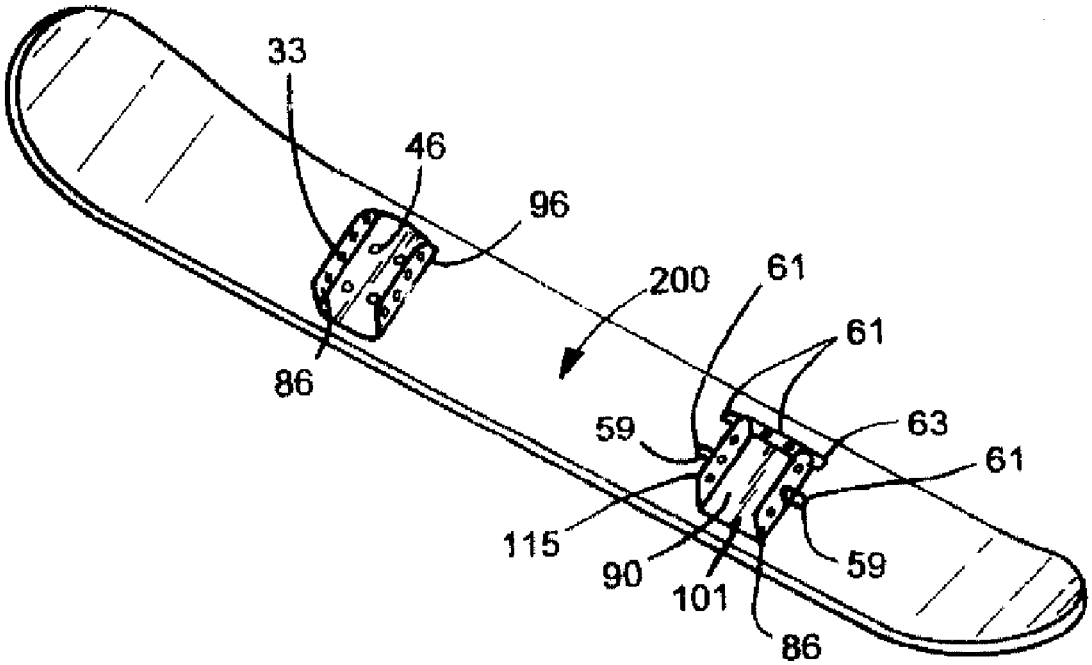
FIG. 24 is a top plan view illustrating a snowboard with an interface equipped to except the mounting plate binding in a locked heel configuration in accordance with the present invention.

FIG. 24 is a top perspective view of a snowboard 200 with a mounting plate 90 attached to the snowboard binding interface 33 with bolts or screws (not shown) through holes 46 to the top side of the snowboard. The mounting plate 90 can be mounted to the interface 33 by placing an axle pivot pin 61 through holes 96 on the snowboard binding interface 33 flange 86 and holes 59 and 63 on the mounting plate 90 locking the mounting plate 90 in a locked heel position.

Figure 25:
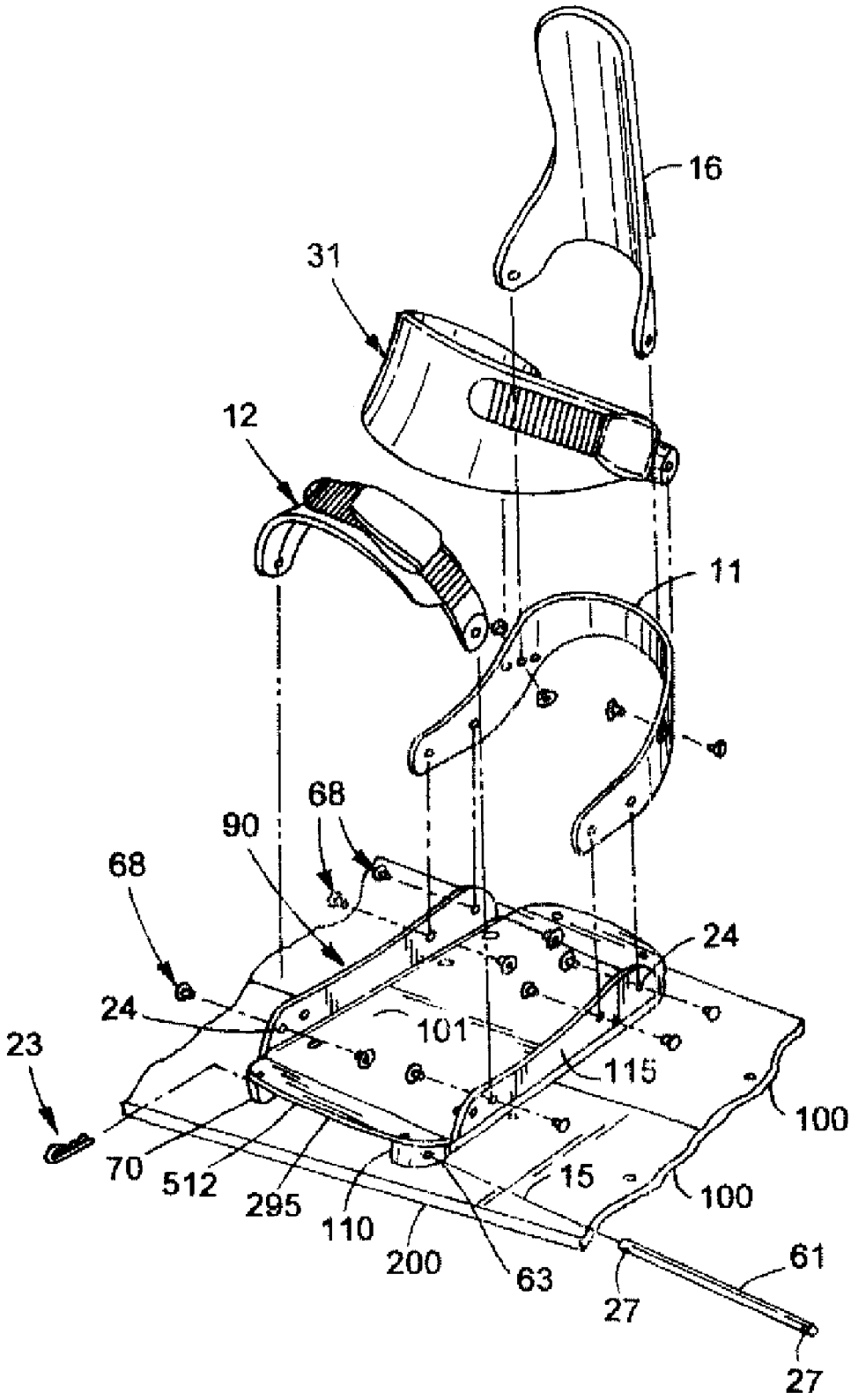
FIG. 25 is an exploded view of the mounting plate, axle pivot pin, and strap assembly in accordance with the present invention.

FIG. 25 is an exploded view of the mounting plate 90 and binding assembly above a sliding device 100 or 200 in accordance with the present invention. The top perspective view of a mounting plate 90 with a touring mode section 60 at the axle pivot pin dock 63 of the mounting plate 90 which accepts the detachable quick attaching pivot axle pin 61 in hole 63 and allows the mounting plate 90 to attach to the top surface of a separate skiing device interface and detach from that location from the skiing device interface. The mounting plate 90 also has at least one secondary locking feature portion behind the touring pivot axle pin 61 location toward more rear ward part of the mounting plate 90. This second locking feature 70 may be located on wall structures 110 below portions of the foot bed 101 on the mounting plate 90. In one embodiment a locking feature 61 moves in a back and forth motion 15 through feature 63 in wherein the motion is perpendicular to the side 115 of the mounting plate 90 forming a transverse axle pivot pin 61 position on the mounting plate 90. In other words the touring mode 63 allows the axle pivot pin 61 to enter from the side of the mounting plate 90 with its two ends extending the periphery of the mounting plate 90 when the axle pivot pin is in place in the touring mode 63.

In one embodiment the binding assembly consists of a heel support 11 and a high back 16 connected to the heel support 11. Also connected to the heel support 11 is rear strap 31. Heel support 11 is connected to the mounting plate 90 flange 115 at holes 24. Holes 24 on the flange 115 can also connect a second strap 12. Foot bed surface 101 is where the boot rests when mounted to the binding system. The toe region 512 or front portion of the mounting plate 90 has a turned up or bent upward toe section 295 to help keep the boot stable (see also FIGS. 1, 6 and 8.)

The axle pivot pin 61 includes two coupling features 27 to selectively lock the axle pivot pin 61 in hole 63 of the touring mode. The coupling features 27 are found at either end of the axle pivot pin 61 to hold a quick-release lock such as a cotter pin 23 or c-clip or anything suitable to quick-release or quick attach at least one end of the two on the axle pivot pin 61 in accordance with the present invention.

It must be noted that one skilled in the art could utilize a multitude of embodiments without leaving the scope of the invention. The invention is unique in that it offers a direct lock and unlocking mounting plate 90 on a sliding device with the said mounting plate 90 intended for soft shelled boots primarily. The mounting plate 90 having a detachable touring pivot 63 or movable touring pivot 63 with a secondary locking mechanism 70 in a mounting plate 90 portion rear of the touring mode 63. Thus we see that the mounting plate 90 does not need a snowboard binding base connected to it nor does it have the ability. The mounting plate already contains strap mounts and the climb and glide touring modes made possible by the axle pivot pin 61 which constitute the basics of the invention The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within meaning and range of equivalency of the claims are to be embraced within their scope.

What is claimed is:

1. A multiple positional binding for coupling a user's boot to a ski touring device, the ski touring device configured to traverse over snow and ice covered terrain, the binding comprising:

a mounting plate having a toe end, a heel end, a top, a bottom, and right and left sides, the mounting plate comprising at least one generally flat surface on top of the mounting plate for a boot to rest upon and a first mounting point on the left side of the mounting plate and a second mounting point on the right side of the mounting plate;

a first mounting feature located near the toe end of the mounting plate, the first mounting feature comprising a first pivot pin, the first mounting feature allowing the first pivot pin to be held in an elongated hollow body of the mounting plate substantially parallel to the generally flat surface and substantially transverse to a length of the mounting plate, the elongated hollow body exposing a portion of the first pivot pin, wherein the first mounting feature is usable to couple the mounting plate to a first binding interface on the ski touring device and wherein the first pivot pin allows the mounting plate to rotate about an axis of the first pivot pin; and a second mounting feature located further towards the heel end of the mounting plate than the first mounting feature, the second mounting feature for coupling the mounting plate to a second binding interface on the ski touring device;

wherein the mounting plate is selectively coupleable to the ski touring device in modes comprising a free heel mode, wherein when first mounting feature is coupled to the first binding interface but the second mounting feature is not coupled to the second binding interface and the mounting plate is freely pivotable about the axis of the first pivot pin, a locked heel mode, wherein the both the first mounting feature and the second mounting feature are coupled to the first and second binding interfaces, the coupled second mounting feature restricting movement of the mounting plate about the axis of the first pivot pin, and an unattached mode, wherein neither the first mounting feature nor the second mounting feature is coupled to the first and second binding interfaces.

2. The multiple positional binding of claim 1, wherein straps are mountable to the first and second upward flanges for securing the boot to the mounting plate.

3. The multiple positional binding of claim 2, wherein the first and second upward flanges comprise one or more holes for mounting straps assembly.

4. The multiple positional binding of claim 1, wherein one or both of the first mounting feature and the second mounting feature comprise quick-release features.

5. The multiple positional binding of claim 1, wherein the first pivot pin comprises at least two locking features, wherein at least one of the two locking features is a quick release locking feature.

6. The multiple positional binding of claim 5, wherein the at least one of the two locking features is one of the group consisting of a cotter pin, a c-clip, a threaded screw, a bolt, a bend in the axle end, a spring loaded mechanism, a flattened axle end, a snapping mechanism, a latch, or a detent.

7. The multiple positional binding of claim 1, wherein the first pivot pin has at least one tether connected to at least one end of the first pivot pin.

8. The multiple positional binding of claim 1, wherein the second mounting feature comprises one or more holes and a locking device, the one or more holes allowing the locking device to be inserted into the holes in a direction transverse to the first pivot pin to couple the second mounting feature to the second binding interface.

9. The multiple positional binding of claim 1, wherein the second mounting feature comprises one or more holes and a second pin, the one or more holes allowing the second pin to be inserted into the holes in a direction parallel to the first pivot pin.

10. The multiple positional binding of claim 1, further comprising additional second mounting features in addition to the first mounting feature and the second mounting feature.

11. The multiple positional binding of claim 1, wherein the mounting plate further comprises at least one downward rail, the downward rail extending below the generally flat surface.

12. The multiple positional binding of claim 1, wherein the ski touring device comprises one of a snowshoe, a ski, a telemark ski, a touring ski, a snowboard, or a split-board.

13. The multiple positional binding of claim 1, wherein the first binding interface comprises a part mounted to a ski touring device.

14. The multiple positional binding of claim 1, further comprising one or more parts comprising the first binding interface and the second binding interface.

15. The multiple positional binding of claim 1, wherein the mounting plate comprises a single manufactured part.

16. The multiple positional binding of claim 1, wherein when the first pivot pin is in its locked position on the mounting plate it extends the periphery of the mounting plate.

17. The multiple positional binding of claim 1, wherein the foot bed has at least one aperture window.

18. The multiple positional binding of claim 1, wherein the mounting plate further comprises traction spikes.

19. The multiple positional binding of claim 1, wherein the first pivot pin is insertable to facilitate rotation of the mounting plate.

20. The multiple positional binding of claim 1, wherein the first pivot pin is coupled to one of the ski touring device and the mounting plate.

21. The multiple positional binding of claim 1, wherein the mounting plate further comprises at least one downward rail, the downward rail extending below the generally flat surface, and wherein the one or more holes of the first mounting feature are located on at least one of the at least one downward rail.

22. A method of coupling a user's boot to a ski touring device, the method comprising:

providing a multiple positional binding comprising, a mounting plate having a toe end, a heel end, a top, a bottom, and right and left sides, the mounting plate comprising at least one generally flat surface on top of the mounting plate for a boot to rest upon and a first upward flange on the left side of the mounting plate and a second upward flange on the right side of the mounting plate, the first and second upward flanges parallel to a length of the mounting plate;

a first mounting feature located near the toe end of the mounting plate, the first mounting feature comprising a first pivot pin, the first mounting feature allowing the first pivot pin to be held in the mounting plate substantially parallel to the generally flat surface and substantially transverse to the length of the mounting plate, wherein the first mounting feature is usable to couple the mounting plate to a first binding interface on the ski touring device and wherein the first pivot pin allows the mounting plate to rotate about an axis of the first pivot pin; and a second mounting feature located further towards the heel end of the mounting plate than the first mounting feature, the second mounting feature for coupling the mounting plate to a second binding interface on the ski touring device;

selectively coupling first and second mounting features to the first and second binding interfaces in modes comprising, a free heel mode, wherein when first mounting feature is coupled to the first binding interface but the second mounting feature is not coupled to the second binding interface and the mounting plate is freely pivotable about the axis of the first pivot pin, a locked heel mode, wherein the both the first mounting feature and the second mounting feature are coupled to the first and second binding interfaces, the coupled second mounting feature restricting movement of the mounting plate about the axis of the first pivot pin, and an unattached mode, wherein neither the first mounting feature nor the second mounting feature is coupled to the first and second binding interfaces, and attaching footwear worn by a user to the mounting plate.

23. The method of claim 22, wherein the footwear worn by the user are attached using straps.

24. The method of claim 22, wherein the footwear worn by the user are attached using a step-in system.

25. The method of claim 22, wherein the mounting plate further comprises at least one downward rail, the downward rail extending below the generally flat surface.

26. The method of claim 22, wherein the mounting plate further comprises at least one downward rail, the downward rail extending below the generally flat surface, and wherein the one or more holes of the first mounting feature are located on at least one of the at least one downward rail.

27. The method of claim 22, wherein the mounting plate comprises a single manufactured part.

28. The method of claim 22, wherein the foot bed has at least one aperture window.

* * * * *